United States Patent [19]

Werding

[11] 4,251,032

[45] Feb. 17, 1981

[54] APPLIANCE FOR DISCHARGING GASEOUS, LIQUID OR PASTY PRODUCT, AND PROCESS OF ITS MANUFACTURE

[76] Inventor: Winfried J. Werding, Grand-Rue 10, CH 1009 Pully, Switzerland

[21] Appl. No.: 84,506

[22] Filed: Oct. 12, 1979

Related U.S. Application Data

[63] Continuation of Ser. No. 843,024, Oct. 17, 1977.

[30] Foreign Application Priority Data

| | | | |
|---|---|---|---|
| Oct. 21, 1976 | [CH] | Switzerland | 13337/76 |
| Feb. 3, 1977 | [CH] | Switzerland | 1519/77 |
| Apr. 12, 1977 | [CH] | Switzerland | 4541/77 |
| Aug. 2, 1977 | [CH] | Switzerland | 9607/77 |

[51] Int. Cl.[3] ..... B05B 11/02

[52] U.S. Cl. ..... 239/323; 222/386.5; 239/491

[58] Field of Search ..... 239/323, 327, 328, 491; 222/386.5, 387, 105, 107, 211, 212, 215

[56] References Cited

U.S. PATENT DOCUMENTS

| | | | |
|---|---|---|---|
| 3,791,557 | 2/1974 | Venus | 222/386.5 X |
| 3,961,725 | 6/1976 | Clark | 222/386.5 X |
| 4,121,737 | 10/1978 | Kain | 222/212 X |

*Primary Examiner*—Richard A. Schacher
*Attorney, Agent, or Firm*—Heinrich W. Herzfeld

[57] ABSTRACT

An appliance for discharging gaseous, liquid or pasty product is described which comprises an inner pouch of deformable non-extensible material for holding the product, an outer enveloping element of caoutchouc-type macromolecular material about the inner pouch, a product outlet associated with the pouch, a valve device for controlling the discharge of product from the pouch through the outlet and being located intermediate the latter and the pouch, and a rigid core associated with the pouch; the cross-sectional area of said core is at least 40% larger than the cross-sectional area, taken in the same plane, of the interior of the outer enveloping element in unexpanded condition, and the maximum fillable volume available in the pouch when the latter is completely unfolded without expansion of its walls constitutes the maximum limit of expansion of the outer enveloping element, the said maximum limit being within the range of linear stretching of the caoutchouc-type macromolecular material.

A process for manufacturing such appliances is also described.

35 Claims, 32 Drawing Figures

Fig. 11
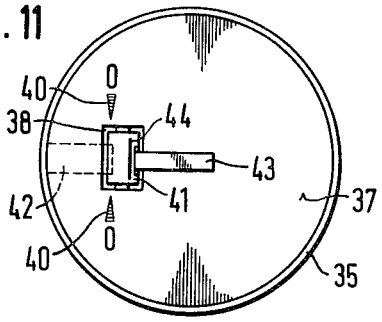
Fig. 12
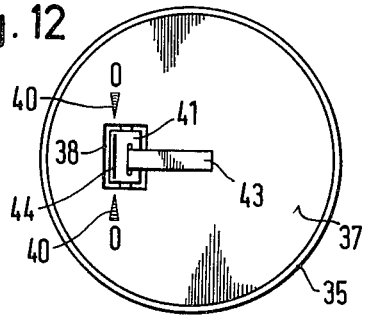
Fig. 13
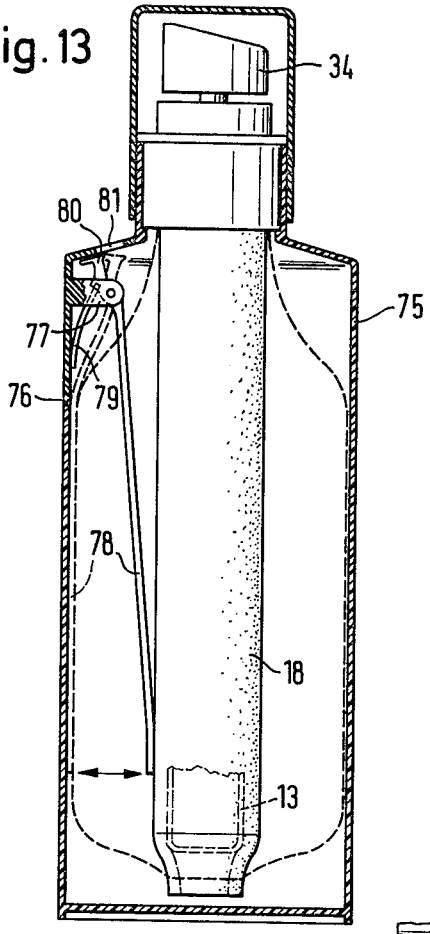
Fig. 14
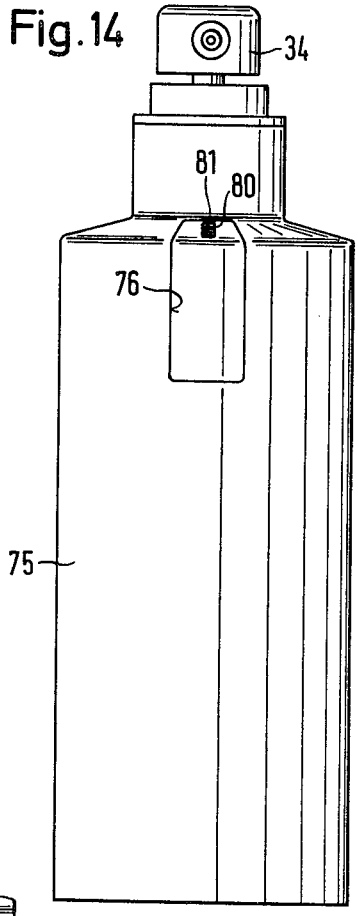
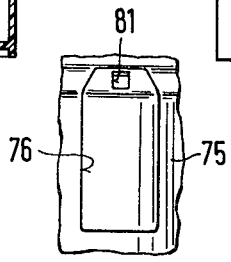
Fig. 15

Fig. 19
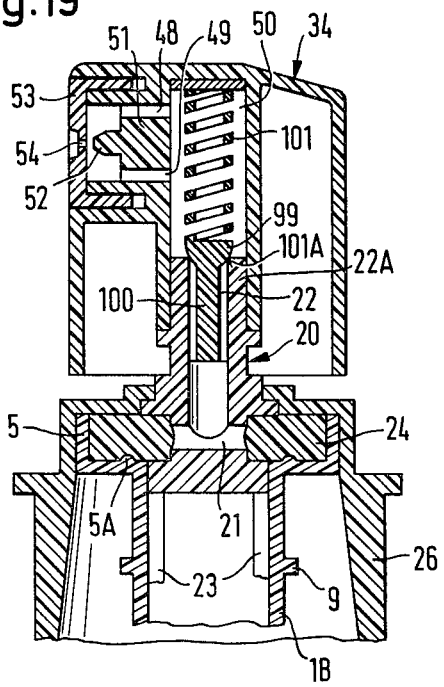
Fig. 20
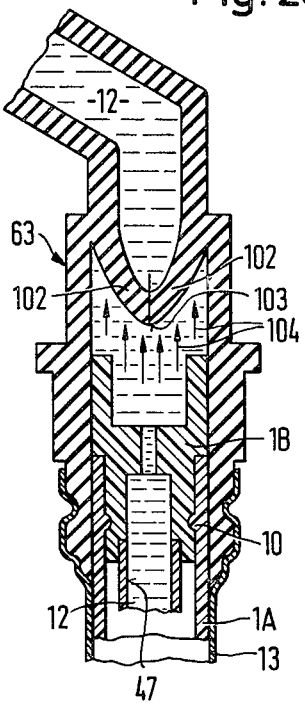
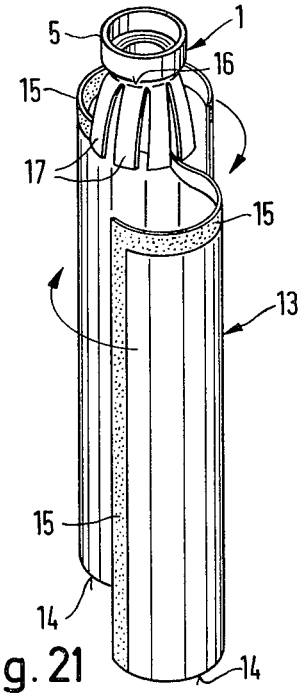
Fig. 21
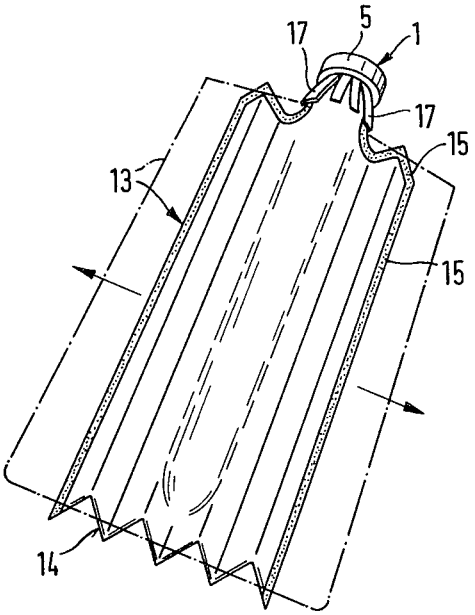
Fig. 22

Fig. 24
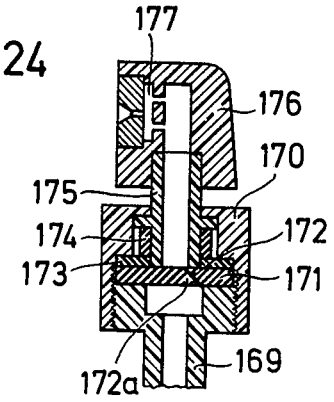
Fig. 25
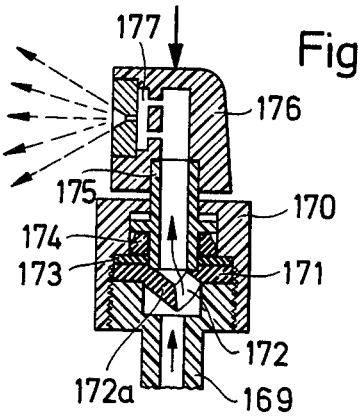
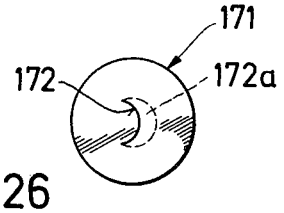
Fig. 26
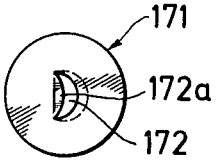
Fig. 27
Fig. 28
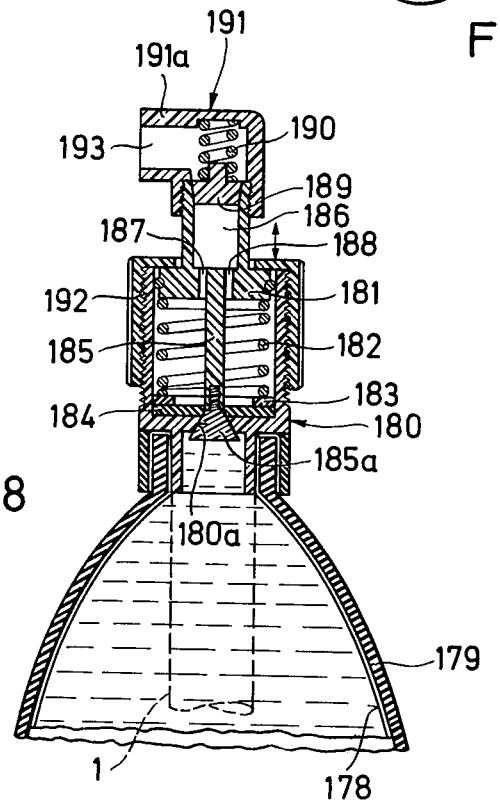

APPLIANCE FOR DISCHARGING GASEOUS, LIQUID OR PASTY PRODUCT, AND PROCESS OF ITS MANUFACTURE

This is a continuation of application Ser. No. 843,024, filed Oct. 17, 1977.

BACKGROUND OF THE INVENTION

This invention relates to an appliance for discharging gaseous, liquid or pasty product, which appliance comprises an inner pouch of deformable non-extensible material for holding the product, an outer enveloping element of caoutchouc-type macromolecular material about the inner pouch, a product outlet associated with the pouch, a valve device for controlling the discharge of product from the pouch through the outlet and being located intermediate the latter and the pouch, and a rigid core associated with the pouch.

In a rapidly increasing number of fields, use is made of sprays for applying products in gaseous, liquid or paste form, for the purpose of body-care, in industry, or even in the kitchen. However, everyone is becoming increasingly more pollution-conscious and, in particular, conscious of the danger of deterioration of the ozone belt which results from the use of means for spraying gases, particularly freon.

On the other hand, the known aerosols present some risk of exploding so that each of them carries a note of precautions that should be taken, for example, that of not placing the aerosol near a source of heat.

Finally, to ensure that the propellant gas cannot pass through them, aerosol sprays have to be made of metal, glass etc., which materials are costly and of a greater weight than plastics material, for example, and require the expenditure of more energy for their production.

In addition, there exist numerous products which cannot be diffused in the form of a spray since they are destroyed by oxidation; these include, for example, food, cosmetic and pharmaceutical products and certain industrial products.

With a view to avoiding all of these problems, a large number of spray appliances that do not use a propellant gas have been proposed. However, none of these known solutions has become firmly established commercially, since they all suffer from more or less serious disadvantages.

Also, the system described in U.S. Pat. No. 566,282, granted on Aug. 18th 1896 to John J. Balley Jr. and mentioning for the first time the use of rubber as an energy-storing means in an atomizer, suffers from the major disadvantage that the product that is present in the container and that has to be expelled is in contact with the rubber, and this greatly limits its use since rubber is chemically unstable when in contact with numerous products. Furthermore, it is not tight to air, spores and bacteria. Apart from this, this atomizer does not enable the product contained therein to be totally expelled since a final proportion thereof that cannot be ejected always remains in the rubber receptacle. Another disadvantage of this system is that neither the expansion nor the compression of the rubber receptacle is controllable, and the vessel is able to assume all shapes, some favorable and some unfavorable to the complete expulsion of the product that it contains.

U.S. Pat. No. 821,875, granted to George M. Kneuper on May 29th 1906, describes means for emptying containers and also makes use of an expansible pouch, which however is stretched along a core which extends into the container and is designed to keep said pouch continuously stretched by holding it in position along the axis of the container. In this way Kneuper partly solved the problem of completely expelling the product without however finding a complete solution. Also, all the problems associated with the use of a rubber container remain unsolved by this spray appliance.

U.S. Pat. No. 2,738,227 of Mar. 13th 1956, granted to G. W. Havens, takes up the ideas disclosed in the two above-mentioned patents and describes an appliance for ejecting a liquid in the form of spray. For this purpose, Havens proposes a core perforated at a large number of points to afford passage to the liquid expelled by the contractive force of a rubber receptacle. It is obvious that this system also suffers from the disadvantage of resulting in a loss of product by non-expulsion, which loss increases with the diameter of the core. Furthermore, if the receptacle is made of natural rubber, its use, as described above, is limited to dealing with a few products, and if the diameter of the core does not make allowance for it, a second loss of product is found to occur, this resulting from final overstretching of the rubber and adding to the lost product remaining in the core.

Numerous other patents, in particular U.S. Pat. Nos. 2,823,953 granted to J. R. George on Feb. 18th 1958, 3,240,399 granted to N. W. Frandeen on Mar. 15th 1966, 3,361,303 granted to C. Jacuzzi on Jan. 2nd 1968, 3,672,543 granted to Plant Industries Inc. on June 27th 1972, and 3,796,356 granted to Plant Industries Inc. on Mar. 12th 1974, describe, with a number of variants, spray appliances utilizing receptacles of elastic materials with or without a core and contained in envelopes and fitted with valves. However, none of these patents describes a spray appliance that is tight to air, spores and bacteria and is unaffected by the product that it is to contain. Furthermore, none of the systems proposed in these patents enables the entire contents of the appliance to be expelled at least approximately linearly during the entire period in which it is used. Apart from this, none of the above-quoted publications describes a spray appliance having a dispensing valve that enables the product to be expelled under pressure in the form of a mist consisting of very tiny droplets.

The same is true as regards the system described in German Patent Application No. 24 42 328 published on Mar. 6th 1975 in the name of Alza Corp., and which describes a container made of synthetic rubber, the inner surface of which may be provided with a covering of likewise elastic rubber which however offers protection against products that would attack the material of the receptacle. In the case of other products, the use of an interior flexible receptacle of synthetic material, for example Mylar, is proposed.

A receptacle made of synthetic rubber of the butyl or nitrile or silicone rubber type results in a very considerable loss of product by non-expulsion because of the fact that synthetic rubbers have a very low permanent elasticity and, after only a few hours under tension, they become overstretched in such a way that a loss of more than 50% of product is incurred. Furthermore, the use of a Mylar film as mentioned above does not result in an air-tight system, and a pouch only be obtained by welding polyethylene to polyethylene, and this means that the layer of aluminium must be on the outside of said receptacle so that it is brought into direct contact with the elastic material. However, unless the coating of aluminium is also plasticized on the exterior, in which case Mylar cannot be used, it breaks down under the high friction effects occurring between the aluminium layer and the elastic material layer both during filling and expulsion of the product, so that the required impermeability of the pouch is adversely affected, since polyethylene alone is not impermeable.

The use of a pouch in plastics material containing a product under pressure is not new. The present inventor has obtained patents in some twenty countries (including Germany, USA and Japan) which are based on the subject-matter of Swiss Pat. No. 484 678, filed on June 27th 1966 and published on Aug. 24th 1968 and describing such a pouch. Furthermore, appliances using a plastics pouch compressed by springs was described and illustrated in a photograph in 1969 in "Lehrbuch und Atlas der Angiologie", Prof. A. Kappert, Editions Hans Huber, Bern. These appliances, which can be used for certain purposes, suffer from the disadvantage of being permeable by aromas and certain germs, so that their applications are limited.

In contrast with the above-mentioned Patents describing a receptacle or pouch of elastic material as a means for storing the energy necessary for expulsion, German Patent Application No. 26 49 722, published on May 5th 1977 in the name of E. I. du Pont de Nemours and Co., describes an elastic fabric obtained by weaving, knotting, crocheting or otherwise uniting elastomeric fibres or filaments with filaments of natural rubber.

This tissue may take various forms including that of a flat envelope. However, if this envelope form is used, it requires means for closing the free end of the envelope so as to prevent it from rising along the inner pouch, or for preventing said inner pouch, if made of rubber, from expanding axially and moving out of the envelope. This can be prevented by means of a core which serves in particular to prevent axial displacement of the envelope towards the valve, and this requires the envelope be closed at its free end so that it can lie firmly against the core.

In this case, the core can be used only in conjunction with an inner elastomeric receptacle having a strong base for the purpose of preventing perforation of the receptacle under the thrust of the envelope; as experience has often shown, a receptacle made of plastics material would not be strong enough and would be pierced.

The various patents mentioned above and numerous other publications illustrate the difficulties in using an elastic material as an element for storing the force required for expelling a product from a container either in the form of spray or any other ejected form. It is known that numerous solutions to the problems enumerated above have been proposed, but they have all had to be rejected for various reasons such as excessively high production costs, over-complicated production methods that are difficult to automatize, the use of materials not suitable for the required application, non-linear delivery, and insufficient comminution of the product which is released in excessively large droplets.

Apart from the spray appliances of the above-described type that do not use a propulsive gas but are fitted with a rubber or plastics element as a source of energy necessary for expelling the product in the container, atomizers are known. This type of spray device cannot be used for all products since, because of the presence of the pumping element, surrounding air and therefore oxygen is pumped into the container, and this is only acceptable in the case of products that are insensitive to oxidation. Furthermore, this atomizer type of spray appliance calls for a certain shape of outer enclosure and requires a change in handling habits on the part of the user of conventional sprays. These appliances are therefore not considered in the following.

The foregoing demonstrates the difficulties encountered in the search for a viable substitute for the conventional aerosol dispenser. These technical difficulties, resulting partially from poor choice of materials and design, are further aggravated by the fact that, to be able to obtain a useful and satisfactory spray appliance which operates without propulsive gas, it is also necessary to take into account the criteria enumerated below.

The prior art shows that the use of a rubber receptacle for accommodating a product and, at the same time, for storing in the wall of the receptacle the force necessary for expelling the product, cannot be achieved, since the only rubber capable of providing an expulsive force that is as linear as possible is natural rubber of the greatest possible degree of purity. However, as stated above this material is not stable, that is to say it does not offer resistance to all products. There is therefore no question of using it as a receptacle for containing the products.

OBJECTS AND SUMMARY OF THE INVENTION

A primary object of the present invention is to provide a spray appliance for gaseous, liquid or paste products that does not use a propellant gas and that solves all of the above-mentioned problems while taking into account the aforementioned criteria, each element, such as the container, the energy-storage element, the valve and the outer enclosure being adapted in the best possible way to suit the envisaged use, and designed to cooperate perfectly with the other elements of the appliance. Furthermore, the appliance in accordance with the invention is intended to fulfil the following conditions.

The appliance aimed at must be economical to manufacture and must lend itself to automatic assembly.

The various elements of the appliance in accordance with the invention must be capable of manufacture in materials requiring a minimum amount of transformation energy and must consist of products that are biologically degradable or are able to destroy themselves without producing toxic gases.

The container of the spray appliance must be impermeable and tight to air, spores, bacteria and all other agencies likely to destroy its contents. Furthermore, it should be so constructed as to enable the product contained therein to be completely ejected. The means for storing the force for expelling the product placed in the container must be capable of ensuring that the entire product is delivered uniformly and linearly. It must be so made that it can continue to contain the product during several months without any appreciable loss of expulsive force. It is necessary that its residual force be sufficient to eject the product entirely. The dispensing valve should be capable of producing a spray that is sufficiently fine to create a mist of product even under unfavorable conditions as regards expulsive pressure. Nor should it comprise any metallic element such as a spring for example. It should also enable the container to be hermetically sealed so as to avoid contamination and dehydration of the product contained therein. The outer enclosure of the spray appliance should allow of the use of an element indicating the state of fill of the container. The appliance should be capable of being used in exactly the same way as conventional sprays, but it should be much cheaper and easier to fill.

Other objects of the present invention will emerge from the following description which refers to the attached drawings which illustrate, by way of non-limiting examples, a number of embodiments of the appliance of the invention.

All of the above-mentioned objects are obtained in an appliance of the initially defined kind wherein the cross-sectional area of said core is at least 40% larger than the cross-sectional area, taken in the same plane, of the interior of said outer enveloping element in unexpanded condition, and wherein the maximum fillable volume available in the pouch when the latter is completely unfolded, without expansion of its walls, preferably constitutes the maximum limit of expansion of the outer enveloping element, the said maximum limit being within the range of linear stretching of said caoutchouc type macromolecular material.

Natural caoutchouc is preferred as material for the outer enveloping element, as it possesses all the properties required in a force-storage means. Pure natural rubber in fact has a hardness of between 40 and 43 Shore units. When such a rubber is caused to expand, a zone of linear resistance to expansion is observed. Beyond 400%, resistance increases considerably. Since various products that it is required to atomize, especially hair lacquers, perfumes, insecticides and air fresheners, require to be extremely finely divided to a particle-size of between 5 and 35 microns, it is essential to have available an expulsive force which decreases only slightly as expulsion of the product proceeds, so as to prevent the size of the droplets of the various products from increasing, which increase is unacceptable in the case of hair lacquer, the layer of which would lose its suppleness, and in the case of perfumes which would stain light-colored clothing, as well as in the case of air fresheners, which, if the droplets forming them were too large, would not be able to evaporate rapidly enough and would mark furniture.

Tests on synthetic rubbers have shown that their acceptable expulsion-force range is very much smaller than that of natural rubber. This fact is of prime importance.

Allowing that use should be made only of a linear expulsive force, it is advantageous for the range to be as great as possible, since the contents of a spray container depend thereon.

If a pure natural rubber in fact provides an almost linear expulsive force giving an expansion of between 450% and 50%, the range of this almost linear force is between approximately 350% and 40% in the case of a synthetic rubber.

Since, whatever the rubber used, it always has a tubular shape when expansion takes place, and the diameter increases as a function of the rate of expansion, a considerable difference in the volume of the contents is observed if it is required merely to use the ranges of linear force described above.

Considering an expansion relationship between "%" and "mm", the following volumes are obtained for one and the same initial diameter and length of tube:

synthetic rubber:

$$300\% = 30\text{ mm} = 15^2 \times 3.14 \times 10\text{ cm} = 70.6\text{ ml};$$

natural rubber:

$$400\% = 40\text{ mm} = 20^2 \times 3.14 \times 10\text{ cm} = 125.6\text{ ml}$$

i e. a difference in the contents of approximately 88% in favor of natural rubber at the moment of maximum expansion.

A further factor favoring natural rubber is that its permanent elasticity is greater than that of a synthetic rubber. Consequently, permanent set due to ageing is less in natural rubber than in synthetic rubber.

The importance of this is obvious since a large degree of permanent set results not only in a reduced expulsion-force rate but also in a considerable loss in the form of unexpelled product because of the lack of contractive force on the part of the rubber.

Since pure natural rubber has a very much smaller permanent set—approximately 15% after 24 months of expansion at 400%, preference must be given to this material.

However, as already stated, natural rubber is not stable when in contact with any one of numerous products and it suffers from the disadvantage of not being impermeable to various gases including oxygen. It is therefore necessary to use a material that is as inert as possible and that offers resistance to the greatest number of products when in contact therewith.

The first choice was a synthetic rubber of the butyl, nitrile and similar type for manufacturing a receptacle designed to contain the product, this receptacle being intended to be fitted within a receptacle made of natural rubber.

Since there is no synthetic rubber that is impermeable to aromas, oxygen and certain micro-organisms (see "Modern Plastics", March 1966, page 1414), and the spray container of the invention is intended to accommodate products which comprise aromas or require to be protected against oxidation and which require to remain sterile, a synthetic rubber is not preferred for use as material for a storage enclosure.

The use of polyethylene and polypropylene films is not possible for the same reasons.

The use of a laminated aluminum foil meets all the requirements regarding impermeability and chemical stability, and numerous tests have shown that satisfactory results are obtained only by the use of a foil consisting of layers of polyester—aluminum—polyester—polyethylene, the thickness of the polyethylene layer preferably being 90 microns. For dealing with products that have to be sterilized, the polyethylene should be replaced by polypropylene which offers greater resistance to heat.

Since this laminated foil is subjected to torsional, frictional and bending forces, it is essential to interpose a layer of polyester between the aluminum and the polyetheylene so as to eliminate the shearing effect of the aluminum.

It has been found that the base of a pouch, obtained by sealing up a laminated aluminum foil, must be in one piece since it is in this zone that pressure is applied by the product; a seal at this zone does not resist pressure and it tears.

Since synthetic rubber having a well-thickness comparable with that of a natural rubber provides a greater expulsive force than the latter without having its mechanical properties, it cannot be used as a force-storage means. The best results are obtained with pure natural rubber. However, on the one hand, its high cost, and, on the other, the volume occupied by a thick wall needed for providing a large expulsive force, implies settling for the pressure available from the use of a rubber wall that is as thin as possible, i.e. having a thickness of approximately 3 mm to obtain the equivalent of a pressure of approximately 1.5 kg/cm$^2$.

This pressure, compared with the pressures normally used in gas aerosols, i.e. 3 to 6 kg/cm$^2$, must be considered as being low. It necessitates the use of a valve or an atomizer specially adapted to suit this pressure and forming part of the present invention.

As explained above, the expulsive force can be considered as being practically linear in the zone of expansion of natural rubber having a hardness of 45 Shore units, between 400% and 50%. It is therefore essential that the rubber should do its work only in this zone if it is desired to obtain a stable delivery of product. This requirement implies the use of a core, disposed along the axis of the pouch, and having a diameter such that the rubber, when stretched to this diameter, cannot contract any more. In this way it is possible to avoid, from the outset, any loss of product due to an increase in the diameter of the rubber receptacle associated with ageing and caused by constant expansion at 400% during the period over which the product is contained in the appliance. Nevertheless, experience has shown that the diameter of said core should not only be 50% larger than the inside diameter of the rubber receptacle, but that preferably it should be 75% greater, since towards the end of the expulsion of the product from the pouch made of laminated aluminum foil, the aluminium, because of the uncontrolled folds that it forms upon compression of the rubber, offers mechanical resistance to this compression, thus reducing the expulsive force. By arresting contraction at 75% expansion instead of 50%, the mechanical resistance of the folds is offset.

However, this requirement brings a new problem: a 75% expansion (i.e. increase of the diameter) of a rubber envelope having a diameter of 8 mm for example corresponds to a diameter of 14 mm for the core around which, furthermore, the pouch of laminated foil is wrapped or folded.

This corresponds to an increase of the cross-sectional area of the rubber receptacle by slightly more than 200%. If, as described hereinafter, said pouch can be introduced without being constrained, it is not possible to prevent the pouch, during filling, from being subject to stress as a result of the rubbing of its wall against the inner face of the rubber tube. Tests have shown that neither talc nor starch can be used as a lubricant, but that silicone oil can and gives satisfaction. Furthermore, it has the advantage of keeping the natural rubber in good condition. However, an envelope of natural rubber, surrounding a pouch as described, causes excessive stress in said pouch due to the fact that the closed base of such an envelope acts on the base of the pouch and pushes it against the core which may lead to perforation of the pouch.

The use of a rubber tube removes this problem and provides satisfaction.

The use of a simple rubber tube as a force-storage means also carries the advantage of low production costs and mass-production manufacture, since the manufacture of a simple rubber tube is a routine straightforward matter and provides a high-quality component.

The pouch and the rubber tube cannot be secured to the valve by high-frequency welding of the polyethylene layer to a valve body of the same material, since the neck of the pouch, formed by a sealing operation, contains two grooves, in the zone of which it is not possible to obtain an airtight seal by welding. The only satisfactory solution is the use of a flexible synthetic rubber tube fitted between the neck of the pouch and the valve body, which tube fills the grooves in the pouch during the clamping operation for securing the latter and thus renders the assembly airtight.

As mentioned above the low pressure provided by natural rubber calls for the use of a special valve since no known atomizer makes it possible to obtain a satisfactorily fine spray, comprising droplets of a diameter varying between 5 and 35 microns according to the particular application, without having recourse to a gas that evaporates almost instantaneously upon contact with air.

The outer enveloping element is preferably a tube extruded from natural caoutchouc. It can also be injection-molded from synthetic caoutchouc-type material.

The thickness of the wall of the outer enveloping element should be at least 2.25 mm, and preferably about 3 mm.

The appliance according to the invention can further comprise an annular sealing element intermediate the upper ends of the pouch and the core.

In preferred embodiments of the appliance according to the invention, the core is hollow and contains a duct having two openings, one at least of which is located at one of the ends of said core; one of the ends of the core forms the seat for a valve body, e.g. a gasket and for piston member and the other end is rounded and has no sharp corner. The surface of the core should be smooth. The core is fitted in a pouch in such a way that its rounded end does not touch the bottom of the pouch. Where the pouch is secured to the core, the latter is provided with fastening means. The pouch is formed preferably by folding a laminated foil and then by sealing it up at the non-folded edges but excluding the outlet. The outer enveloping element has the shape of a tube having two ends, the upper end of which tube is fastened sealingly to the pouch or the core or both, while the lower end of the tube is preferably open and extends downwardly beyond the bottom of the pouch. The caoutchouc tube is longer than the pouch so that the bottom of the pouch is located within the tube, and clamping means should be provided for pressing the neck of the pouch and the end of the caoutchouc tube surrounding the pouch sealingly against the fastening means on the core. The valve device comprises the said seat on the core, and a gasket made of plastics material.

Preferably, the core is elongated and contains in its interior a conduit having at least two openings, at least one of which openings is located at a first end of the elongated core, which core end is directed toward the valve device, while the other end of the core is closed.

An atomizing nozzle or a discharge spout can be provided in a dispenser head, which is preferably depressable by a finger to operate the appliance. The nozzle has an expulsion mouth.

An advantageous and particularly preferred embodiment of the appliance is equipped with an atomizer which comprises at least two successive turbulence-generating stages of channels, successively arranged in the direction of flow of the product through said nozzle and imparting rotation to the product flow therethrough, the following stage being superimposed on the preceding stage and imparting rotation to the product in the same sense as the preceding one. Preferably, the nozzle has a central nozzle chamber and at least two connecting ducts leading from the central nozzle chamber to the expulsion mouth. Preferably, the connecting ducts run parallel to the central axis of said expulsion mouth; four such connecting ducts are particularly preferred.

The sum of the areas of the cross-sections of the several ducts in the core, valve seat, plunger or piston and atomizer preferably diminishes as the said ducts approach an expulsion mouth in the dispenser head, the volumes of the spaces in the second turbulence-inducing stage likewise being less than those of the first stage.

The nozzle can comprise first and second nozzle body parts superimposed on one another, as first and second stages of channels. The first nozzle body part having the aforesaid central nozzle chamber; an annular space or groove, near or in the face of the first nozzle body part being in contact with the second body part, and at least two connecting ducts leading from the central nozzle chamber to the last-mentioned face of the first body part. The second nozzle body part then contains rotation-imparting grooves or ducts leading from the annular groove to the expulsion mouth, and the end face or tip of the first body part, which face or tip is encircled by the annular groove, is spaced from the entry to the explusion mouth.

The total volume of the rotation-imparting grooves or ducts is x times as large as the volume of the annular groove, x being equal to the number of connecting ducts in the first body part and preferably 4, and the distance from the end face or preferably cone-shaped tip of the first body part to the entry of the expulsion mouth is then advantageously one xth of the depth of the rotation-imparting grooves or ducts.

In the last mentioned case, when x is equal 4, all passages for product from the pouch through the valve device to the product outlet are preferably so dimensioned that the discharge rate of product is about 0.5, and preferably 0.25, gram per second independently of the pressure prevailing in said pouch on the product therein.

The first and the second nozzle body part are preferably aligned with one another along the central axis of the expulsion mouth. Advantageously, the openings for product entry of the rotation-imparting ducts are located near the periphery of the annular groove about the said end face or tip.

In order to facilitate manufacture, the core can consist of two parts, at least one of which is of adjustable length.

Preferably, the cross-sectional area of the core is at least 75% larger than the cross-sectional area of the interior of the unexpanded outer enveloping element.

The above-mentioned piston is of plastics material and comprises spring means consisting of resilient fingers integral with the piston and protruding into an adjacent recess of said core.

In a preferred embodiment of this type, the device comprises a piston member adapted for obturating the valve seat and having ducts for the flow therethrough of product from the pouch to the nozzle. In this case also, the sum of the cross-sectional areas of all product passages in the core, part the valve seat and through the piston, and in the nozzle preferably diminishes in the direction of product flow toward the expulsion mouth, and the total volume of all product flowpaths in the second stage is preferably smaller than the corresponding total volume in the first stage.

The valve device can comprise gasket means for obturating the passage of product from the pouch into the product flowducts in the piston, said gasket means being of synthetic caoutchouc and serving as a return spring for said piston. The gasket means should be of sufficient thickness to obturate an orifice of the ducts in the piston which orifice has a diameter above 0.5 mm.

The valve device can further comprise a second piston lodged in the central nozzle chamber and being spring-loaded to obturate flow of product from a duct in the piston member mentioned hereinbefore into the central nozzle chamber. Preferably, the valve device comprises two slot valve bodies of elastic plastics material at opposite ends of the valve device, one of which valve bodies closes against the direction of product flow and the other against the direction of influx of ambient air into the valve device, and means for deforming the valve bodies for opening the slots of the valve bodies.

In a preferred embodiment of the appliance according to the invention, the pouch is made of deformable laminate sheet material constituted of at least three layers, namely, an outer layer which is of polyester, an intermediate layer which is of aluminium foil and an inner layer of polypropylene, the latter layer being destined for contact with the product. Advantageously, the laminate sheet also comprises a layer of polyester interposed between the intermediate aluminium layer and the inner layer.

The intermediate aluminium layer preferably has a thickness of at least 9 microns and the innermost polyethylene or polypropylene layer has preferably a thickness of at least 50 microns, optionally at least 75 microns.

In a preferred embodiment, the pouch advantageously comprises a neck having an outlet opening, and the portion of the pouch next adjacent said neck has a shoulder and the part of the pouch away from the shoulder has accordeon-type folds.

The pouch can comprise, about an outlet orifice thereof, a plurality of fingers adapted for being passed over and about the outside of the upper open end of the outer enveloping element.

The appliance of the invention can further comprise an indicating device for indicating the degree of filling of the pouch with product, which indicating device is preferably adapted for measuring the degree of expansion of the outer enveloping element.

The valve device can comprise a control means for closing the valve device when the pressure on the pouch is insufficient for expulsion of product therefrom.

The process for the manufacture of an appliance according to the invention can comprise the steps of assembling the core, pouch and valve device, radially expanding the outer enveloping element and then sliding the same over the assembled core, pouch and valve device free from exercizing any constraint on the pouch, and finally clamping the upper part of the outer enveloping element on to the pouch and core underneath the junction of the latter with the valve device.

This process can further comprise the step of applying to the internal wall of the outer enveloping element a silicone oil layer prior to sliding the element over the assembled pouch, core and valve device; it can further comprise the step of applying a clamping device to the assembled pouch, core and valve device to hold these parts together prior to sliding the outer enveloping element over these clamped parts.

BRIEF DESCRIPTION OF THE DRAWINGS

Details of the invention will now be described by reference to a preferred embodiment which is illustrated in the annexed drawings, wherein:

FIG. 11 shows a device for indicating the state of fill, in the full position, FIG. 12 shows this device in the empty position, FIG. 13 is a view, partly in section, of another form of device for indicating the state of fill, FIG. 14 shows said device in the full position, FIG. 15 shows said device in the empty position, FIG. 19 is a sectional view of a closure means when no pressure occurs, FIG. 20 shows a valve of lippered form, FIGS. 21 and 22 show two different methods of mounting the container on the core, FIG. 24 is an axial sectional view of another embodiment of a spray head having a valve in closed position, FIG. 25 is a similar view, but showing the valve in the spray head in open position, FIG. 26 shows in plane view a rubber lip valve serving as valve body in the spray head of FIG. 24 and 25, FIG. 27 shows the same valve as FIG. 26 in open position, FIG. 28 shows in sectional view another embodiment of the appliance according to the invention comprising a dosing valve.

DETAILED DESCRIPTION OF THE EMBODIMENTS ILLUSTRATED IN THE DRAWINGS

Figure 1:
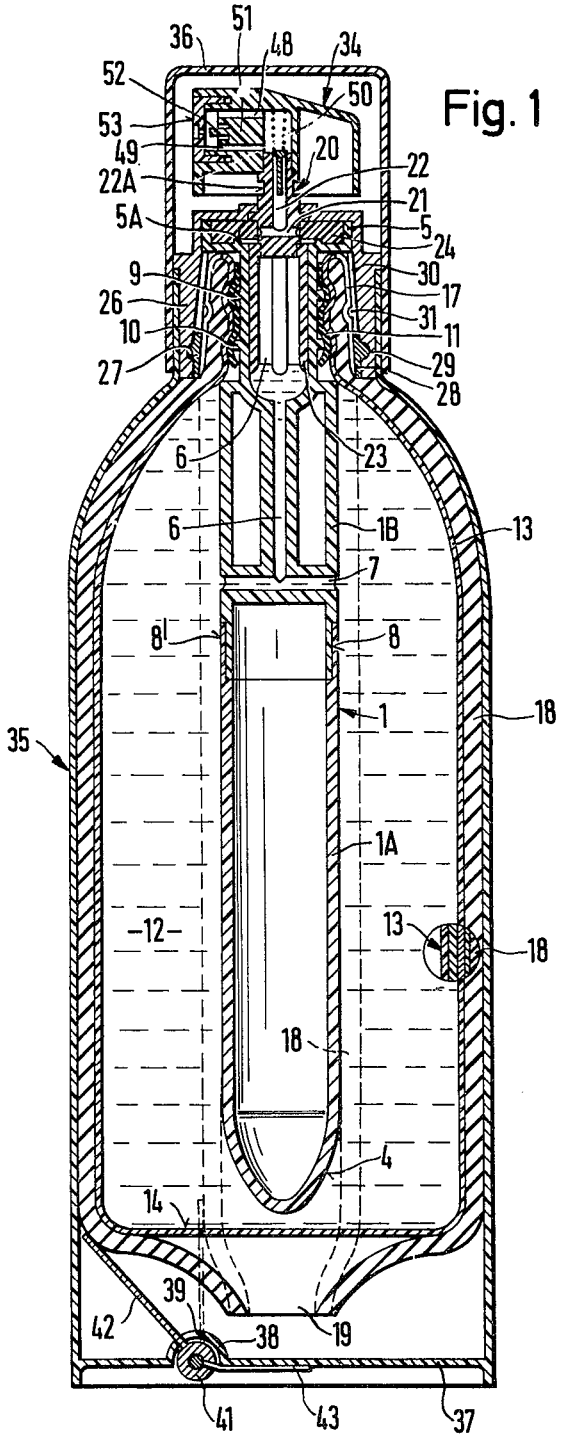
FIG. 1 is a sectional view of a preferred embodiment of the appliance according to the invention.
Figure 2:
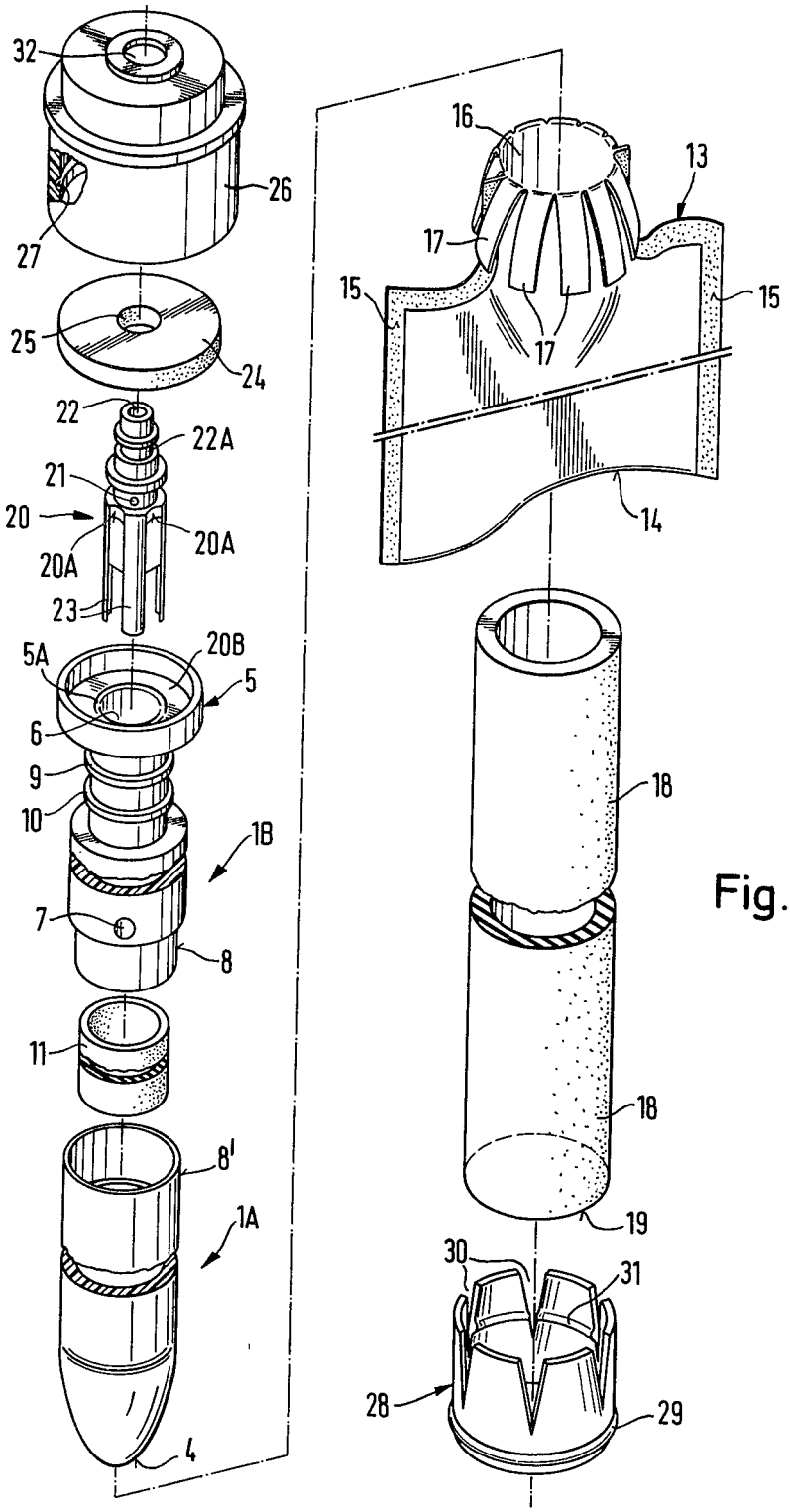
FIG. 2 is an exploded perspective view of various parts.
Figure 7:
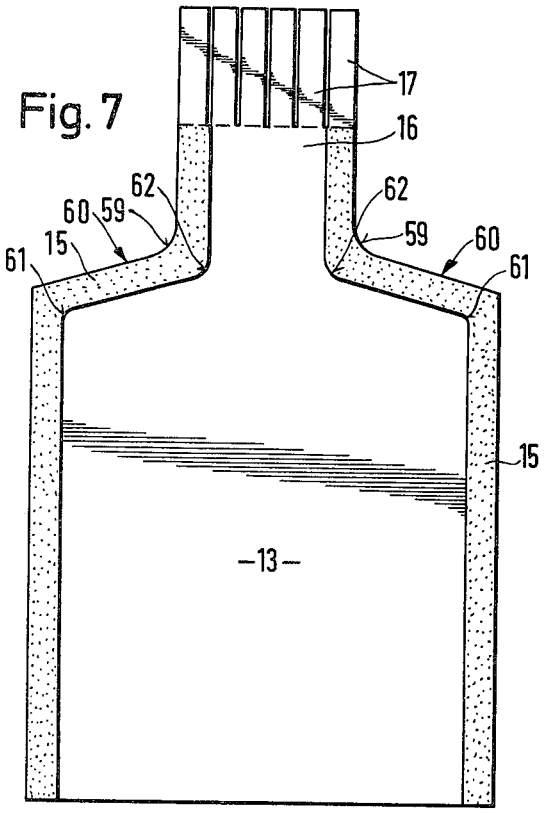
FIG. 7 is a plan view of a pouch.
Figure 8:
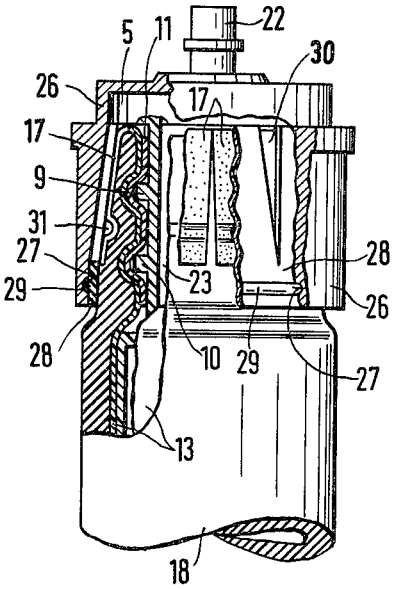
FIG. 8 is a view, partly in section, showing the method of securing the various parts used.

FIG. 1 shows a sectional view of a spray appliance in accordance with the invention and filled with a liquid that is to be atomized. The valve arrangement required in this appliance comprises a core 1, made of plastics material, which consists of two parts 1A and 1B. The part A1 is an enclosure or cartridge open at its upper end 8, while its lower end 4 is closed and preferably of ovoidal shape. The surface of the enclosure 1A is as smooth as possible. Its length is variable and this enables said core 1 to be adapted to suit the dimensions of a spray container, that is to say that the smaller the contents, the shorter the core 1 will be for a given initial diameter. It is obvious that this diameter will be smaller for a spray container having a capacity of 100 ml than for a container having a capacity of 1000 ml. At its upper end, part 1B of the core 1 has a seat 5 and a central duct 6 which opens at its inner end into a transverse duct 7. The upper end 8 of part 1B has a necked portion whereby it can be fitted in the lower end of part 1A so as to form the complete core 1. Below the seat 5 part 1B bears annular ribs 9 and 10, and a tubular joining and sealing element (called hereinafter a "joint" for the sake of brevity) which is preferably a tube of synthetic rubber of the nitrile rubber type, i.e. a compressible synthetic material which, in contact with the product 12, should not be attacked by or attack the latter. The joint 11 seals off a pouch or bag 13 which is made of a laminated aluminium foil preferably comprising four layers, namely: polyester—aluminium—polyester—polyethylene or polypropylene, these latter being in contact with the product 12; polypropylene may be preferred because of its greater resistance to heat when the product 12 to be sterilized in an autoclave. The pouch 13 is formed by sealing up an aluminium foil folded along a folding line 14 and sealed along a sealing line 15 as shown in FIG. 7. At its neck 16 the pouch 13 has a plurality of lamellar portions 17. These enable the pouch 13 to be firmly secured to the core 1 as will be described hereinafter. The base of the pouch 13, illustrated by the fold 14, should not be sealed up, but constituted by a fold in a continuous laminated foil as described, since the pressurized product 12 applies thrust particularly against the base of the pouch 13 which, since it is housed within a rubber tube 18, is not "reinforced" by the rubber, the lower end 19 of the tube 18 being open. Experience has shown that sealing up of the base does not provide resistance to the thrust applied by the product 12. It is, however, possible to form an additional seal along the fold 14 to impart to the pouch 13, when folded, a taper that facilitates its introduction into the tube 18, this seal then providing protection for the base of the pouch 13 against excessive constraint when the pouch is introduced into the tube.

The core 1 carrying the pouch 13 together with the joint 11 is housed within the rubber tube 18. The latter is made of a practically pure natural rubber having a hardness in the order of 45 Shore units. At an expansion of 400%, a wall having a thickness of 1 mm provides a contractive force which brings the product 12, contained in the pouch 13, under pressure of approximately 0.6 kg/cm$^2$. The wall-thickness of the tube 18 is therefore selected in dependence of the pressure at which is required to expell the product 12. It would be obviously possible to use a wall having a thickness of 5 mm for obtaining a pressure of approximately 3 kg/cm$^2$, but not only is this amount of natural rubber costly but it also represents a considerable unnecessary volume and weight. For this reason preference has been given to the use of an atomizer which, for a pressure of 1.2 kg/cm$^2$, provides the same result as the known atomizers providing a pressure of 3 kg/cm$^2$ and more, and this therefore permits the use of a relatively thin wall for the tube 18, this permitting the pouch 13 to be made from a very thin laminated foil which offers mechanical resistance compatible with the contractive force of the rubber. The method of introducing the core 1 and the pouch 13 will be described hereinafter.

The duct 6 is devised as a cylinder to receive a plunger 20 which is provided with a transverse duct 21 and a central axial duct 22 opening with its lower end in duct 21 and a plurality of axial grooves 20A and having axial ribs therebetween which end is extensions of fingers 23 directed into the cylinder formed by duct 6. The plunger 20 is made of a plastics material having a certain spring-force, so that these extensions 23 function like blade springs and render a metal return spring unnecessary. A further spring action is achieved by the use of a relatively large thickness for the polyacrilonitrile gasket 24. This thickness serves a further purpose: it enables the duct 21 to be of sufficiently large diameter to avoid reduction of the thrust necessary for the functioning of the atomizer shown in FIGS. 3, 4, 5 and 6.

Figure 6:
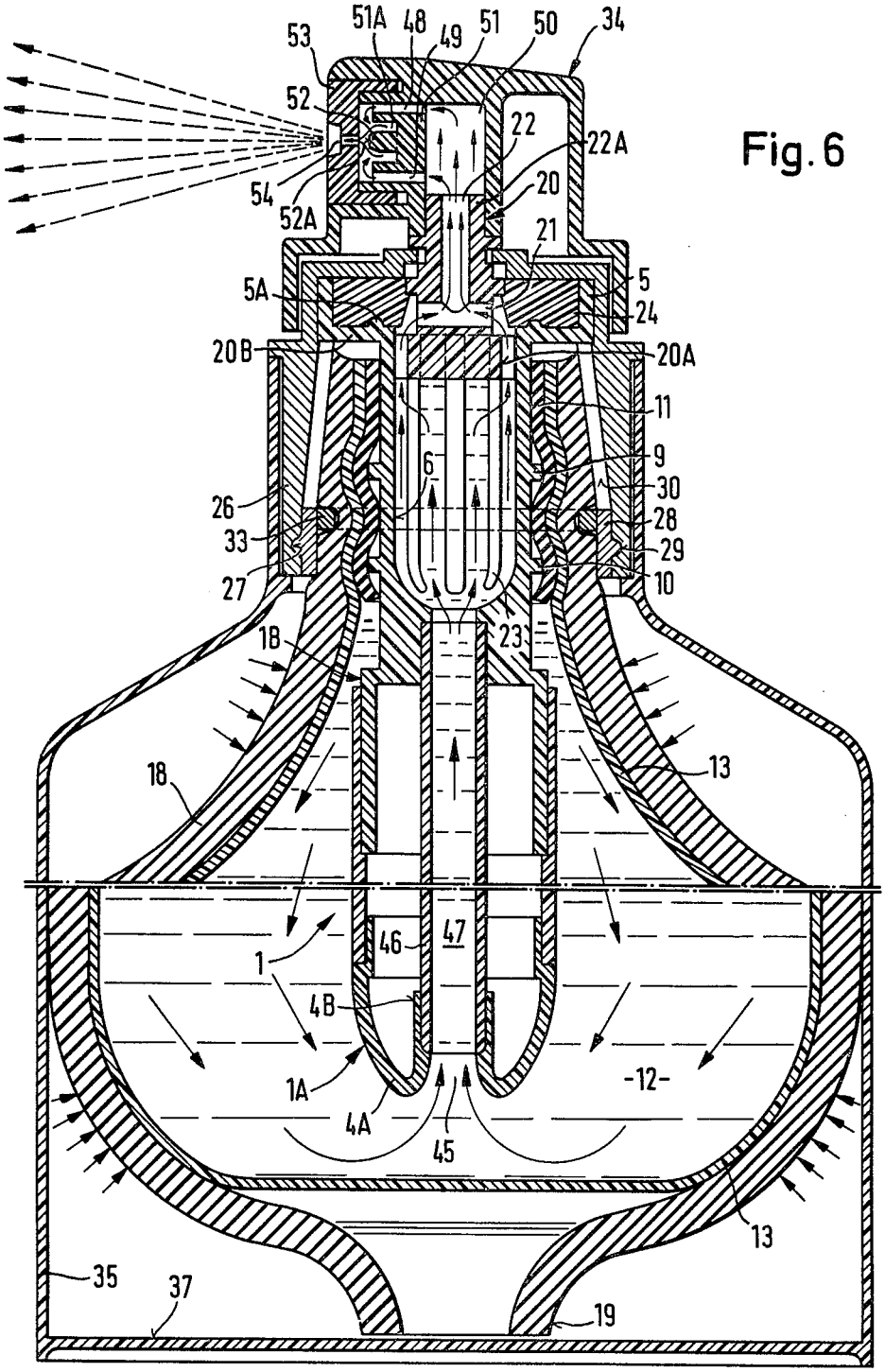
FIG. 6 is a sectional view on a much larger scale showing the mode of operation of the embodiment of FIG. 1.

The gasket 24 has a central hole 25, the diameter of which is such that the gasket 24, when fitted on the plunger 20, applies strong pressure at the openings of the transverse duct 21 which duct is thus obturated. The gasket 24 is housed in the seat 5 which has an annular shoulder 20B on which the gasket 24 bears. The core 1, the pouch 13, the tube 18, the joint 11, the plunger 20 and the gasket 24 are secured together with the aid of a bushing 26 and a sleeve 28 bearing an annular rib 29 on the lower peripheral zone thereof, which rib 29 protrudes into an annular groove 27 in the inside surface of bushing 26. These parts are secured together in the following manner: the sleeve 28 has notches 30 in an upper rim part thereof and an interior annular rib 31. The latter is located at such level that, when assembly is carried out, it is lodged between the annular ribs 9 and 10 of the core 1. The interior surface of the bushing 26 is conically tapered so that the central passage or bore 32 in the bushing 26 widens downwardly. When the core 1, carrying the joint 11, is introduced into the pouch 13, the lamellar portions 17 of the neck 16 of the latter are positioned like a crown below the seat 5, and when this assembly is placed in the tube 18, the lamellar portions 17 become positioned outwide the tube and parallel to the axis of the core 1. After the plunger 20, fitted with the gasket 24, has been introduced into the duct 6 of the core 1, the sleeve 28 is slid over the tube 18 and the lamellar portions 17 until it bears against the seat 5 of the core 1, and the assembly is introduced into the bushing 26 so that the portion 22 of the plunger 20 passes through the bore 32 of the bushing 26. Since the interior surface of the bushing is tapered, the notches 30 in the sleeve 28 close up and thus, the latter applies a clamping pressure so that the lamellar portions 17, the tube 18, the pouch 13, the joint 11 and the core 1 are pressed firmly against each other. The rib 31 becomes positioned between the ribs 9 and 10, thus preventing any axial displacement of these parts relative to each other. The rib 29 on the sleeve 28 moves into the groove 27 in the bushing 26, which then presses the gasket 24 firmly against an annular bead 5A on the seat 5, so that the assembly is rendered airtight. Since the sleeve 28 bears against the seat 5 from below, and the bushing 26 bears against the same seat 5 from above, no displacement of the latter is possible. Initially, attempts were made to secure the assembly in the same manner but without the lamellar portions 17, and it was found that the pressure of the product 12 when applied to the bottom 14 of the pouch 13 caused the latter to slide towards the opening 19 of the tube 18, and product 12 could escape. The lamellar portions 17 prevent this sliding since the pouch 13 is secured by them at a plurality of places. The lamellar portions 17 can be dispensed with when using a collar 33 as illustrated in FIG. 6. This alternative arrangement can be used as a measure for ensuring operational safety when the product 12 is to be sterilized at 120° C. or even 140° C., since the plastics material used for the bushing 26 and the sleeve 28 may undergo a slight temporary deformation at these temperatures and may no longer fully afford the necessary clamping action.

The part 22A of the plunger 20 surrounding the central duct 22 carries an atomizer or dispenser head 34 which will be described hereinafter (FIG. 19).

The arrangement so far described is placed in a container 35 which is closed by a cap 36. Since these two parts are not subjected to any pressure, they can be made of a thin inexpensive plastics material, or even of cardboard. Formed on the base 37 of the enclosure 35 is a recess 38 which has an opening 39, and the exterior of said base is marked with arrows 40 indicating a position "O" (FIGS. 11 and 12). Fitted in this recess 38 is a pivot member 41 which has affixed thereto a rod 42 and a blade spring 43 and carries a pointer 44. The rod is introduced into the interior of container 35 through the opening 39, whereas the blade spring 43 bears against the container base 37 so that the rod 42 is always urged with a slight pressure against the outside of a circumferential wall zone 18A of the tube 18. When the pouch 13 is empty, the rod 42 occupies the position indicated by broken lines in FIG. 1, and the pointer 44 is then coaxial with the arrows 40 as shown in FIG. 12, thus indicating that the spray appliance is empty. When the container is being filled with the pressurized product 12, the tube 18 is caused to expand the therefore displaces the rod 42 which, by way of the rotation imparted to the pivot member 41, moves the pointer 44 out of alignment with the arrows 40 as shown in FIG. XI, thus indicating that the spray container is not yet empty. This indicating system is extremely useful since, if for example the user is about to set off on a journey and does not know whether the product can be obtained during the same, the pointer indicates the degree of filling and therefore the reserve of product available until the next purchase must be made.

FIG. 6 illustrates another embodiment of core 1. Core part 1A is constituted by a cylindrical sleeve while its bottom end is constituted by a cap-shaped member 4A of hemi-ovoidal contour having a central opening 45 at the lowermost tip thereof being surrounded inside cup-shaped member 4A by a sleeve part 4B. The core part 1B does not have a transverse duct 7. The central duct 6 is connected via a duct 47 in a tubular member 46 to the aforesaid opening 45 in the sleeve part 4B. For the purpose of spraying the product, it is best to have a sufficiently large column thereof in duct 47 so that this column is able to absorb unexpected movements of the product 12 under the influence of the mechanical resistance of the pouch 13; without this column in duct 47, spray would issue from the atomizer nozzle 54 in head 34 in spurts, as experience has shown. The spacing of the openings of the transverse duct 21 from the opening 45 of the valve arrangement also results from the experience gained. Whatever the material used for the pouch 13, its attachment to the tube 18 causes at this location, and particularly towards the end of the expulsion of the product 12, a marked throttling action which influences delivery, and this is not acceptable if the product concerned is a medicament which a patient, without realizing it, has got into the habit of dispensing on the basis of the length of time that the valve is open. The delivery rate should therefore be as uniform as possible if the amount of medicament dispensed is to correspond to a correct dose. In the case of a hair lacquer or a perfume, a reduction in the delivery rate results in an unacceptable increase in the particle-size of the product 12.

Figure 3:
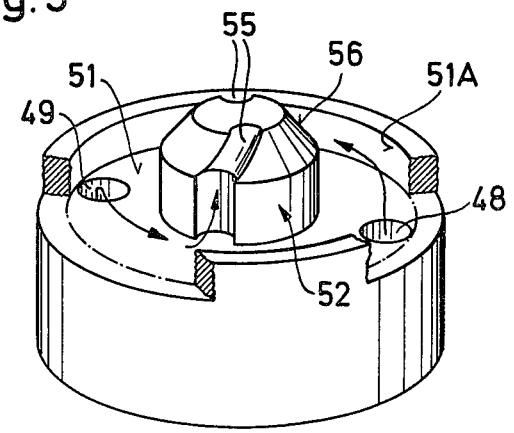
FIG. 3 is a perspective view of part of an atomizer.
Figure 4:
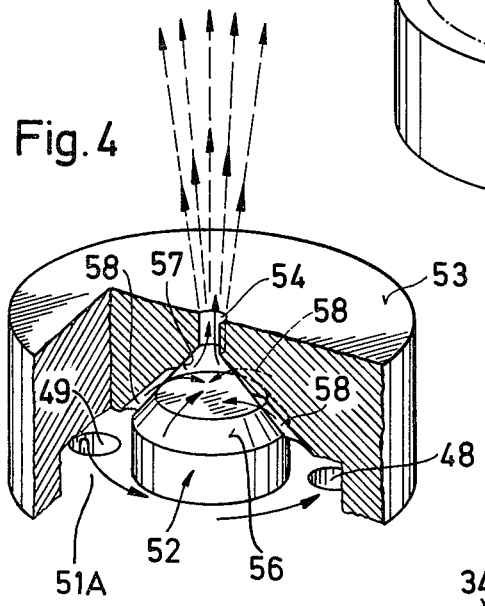
FIG. 4 is also a perspective view of part of an atomizer.
Figure 5:
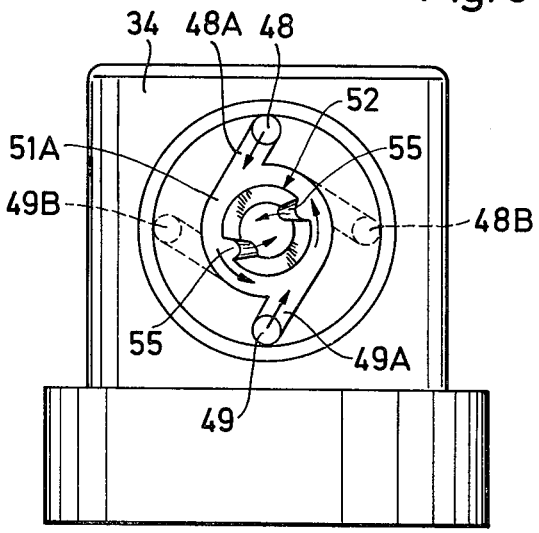
FIG. 5 is a front view of part of atomizer.

FIGS. 3, 4, 5 and 6 illustrate embodiments of atomizers especially designed to suit the low pressure prevailing in the spray container in accordance with the invention. Since the system in accordance with the invention does not provide sufficient pressure to enable known atomizers to be used, efforts were made to find a means for accelerating the product as it approaches the nozzle ejection duct 54 while supplying a sufficiently large mass of pressurized product of this nozzle. These efforts were justified for the following reason: the propellant gas used in aerosol sprays is also a solvent, the cost of which is only approximately one-third of that of another solvent, ethyl alcohol. Therefore, to be competitive, the product 12 in a spray container in accordance with the invention must be mixed with a solvent which, if possible, is less expensive than the propellant gas. This solvent should therefore be atomized to an extent such that it evaporates like a propellant gas owing to the fineness of the droplets thereof produced by atomization. Since the system in accordance with the invention does not provide the pressure necessary for achieving this effect, it was necessary to develop an atomizer which ensured a micro-diffusion of water. The dispenser head 34 in accordance with the invention is provided with a central chamber 50 and with two separate channels 48 and 49 provided in an intermediate transverse nozzle wall 51 leading radially out of central chamber 50 and being connected by tangential grooves 48A and 49A to an annular groove 51A in the outwardly directed face 52A of nozzle wall 51 which groove 51A leaves a needle 52 at its center. The dispenser 34 carries a nozzle body 53 having an ejection duct 54. Nozzle body 53 is so fitted in head 34 that it covers the tangential grooves 48A, 49A and annular groove 51A, the causing the product 12 to move along a circular path. The needle 52 may take various forms. FIGS. 3 and 5 show a needle 52 having a tapered end with oblique channels 55. In this construcion use is made of a nozzle insert 53, which has been omitted to show the underlying nozzle parts; the ejection duct 54 is longer than the tapered portion of the needle 52 so that there is formed a kind of expansion chamber upstream of the point where this tapered opening becomes cylindrical. In this system the product is caused to move along a circular path in the groove 51A and it can escape only along the oblique grooves 55 in the needle 52. Two circulatory paths are thus created, one being perpendicular to the other. Since the cross-section of the various grooves diminishes as the grooves approach the ejection duct 54, the product 12 gains in speed while moving along a circular path, the size of the cross-section of the channels 48 and 49 being so selected that they transmit the entire pressure of the product into progressively narrower spaces, this resulting in the required atomization.

FIG. 4 illustrates a further embodiment of the nozzle arrangement. Herein the needle 52 has no grooves 55. A conical tip portion 56 of needle 52 is fitted in a tapered inner wall 57 in the nozzle insert 53 which latter is partly cut away. In the tapered wall 57 there are four preferably oblique grooves 58 which are in communication with the annular groove 51A and are of such length that they are able to receive the product 12 emerging from the groove 51A. The grooves 58 are partly covered by the conical portion 56 of the needle 52 so that the ends of grooves 58 that are in communication with the annular groove 51A forms only very narrow orifices through which the product 12, already rotating in the annular groove 51A, is able to escape and is then caused to rotate again by the grooves 58, after which it is finally ejected through the ejection duct 54. This system offers the advantage of using the centrifugal force that rotation imparts to the product 12 in the ejection duct 54, so that an acceleration is achieved which progressively increases as the product 12 approaches the ejection duct 54. This results in very fine atomization, even in the case of an aqueous solution.

In the embodiment shown in FIG. 6 there is illustrated another type of atomizer which, depending upon the viscosity and particle-size of the product, is entirely satisfactory. The needle 52 does not reach into the tapered opening of the nozzle insert 53, but extends as closely as possible thereto, that is to say the closer the part of the flat surface 52A on the tip of needle 52 is to the ejection duct 54, the finer are the droplets. In addition to the channels 48 and 49, this system comprises two further channels 48B and 49B and tangential grooves associated therewith indicated by the broken lines in FIG. 5. The product 12 passes through these four ducts and their respective tangential grooves into the annular groove 51A where it is caused to rotate before issuing in the atomized state through the duct 54. The mass of the product 12 and the cross-section of the various grooves determine the distance between the flat surface 52A on the tip of needle 52 and the nozzle 53. The greater the mass, the greater this distance should be.

The atomizers that have been described enable the system to be suited to the viscosity of the product 12 by varying the diameter of the channels 48 and 49 and of the two additional channels 48B and 49B. The fineness of the droplets, i.e. the quantity delivered per time unit, may be adjusted either by varying the distance between the needle 52 and the duct 54, or by reducing or increasing the cross-section of the various grooves, whereas the angle of the spray cone at which the atomized product issues from the duct 54 will depend upon the length of this duct; the longer this duct the smaller the angle of the spray cone will be.

FIG. 19 illustrates a device for blocking the product flow-controlling valve when a drop in pressure occurs in the product. It is in fact found that at the moment when the tube 18 can no longer contract, i.e. at the moment when all expulsive force ceases, the product 12 is nevertheless expelled, but unfortunately no longer in a pulverized form comprising fine droplets, but in the form of a jet (spitting). This expulsion is due to the fact that the contractive force ceases because the tube 18 abuts against the core 1 as envisaged. The thrust from this displacement by mass inertia of the product 12 is clearly insufficient for atomizing the product. However, it is necessary to prevent products such as hair lacquer, perfumes, paint etc. from issuing from the spray container in a poorly atomized or unatomized form.

The device shown in FIG. 19 overcomes this difficulty. It is housed in central chamber 50 in head 34 and comprises a hemispherical valve element 99 made of plastics material and provided on its hermispherical side with a pin 100, and on its flat side with a spring 101, the pivot 100 and the spring 101 being firmly connected to the element 99 and being made of the same material as this element. Seen in plan and in section, the pivot pin 100 is in the form of a cross, the ends of the bares of which are in contact with the wall of the axial duct 22 of the plunger 20, in which duct this pivot pin 100 is fitted. The spring 101 bears against the inner top wall of head 34 and pushes the hemispherical element 99 onto a seat 101A about the upper opening of the duct 22, which duct is thus obturated. The force exerted by the spring 101 is so selected that it only resists the thrust from the product 12, moving without being pressurized. The spring 101 will obviously be compressed by the expulsive force of the product when the latter is pressurized by the flexible tube 18, and this causes the hemispherical element 99 to move away from the duct 22 thus leaving an open space for the product 12 to pass into the chamber 50 in the dispenser head 34.

FIG. 7 illustrates a pouch 13 as described, but includes the technical details necessary for obtaining reliable operation. When being filled and also during discharge of the product 12 contained in the pouch 13, the latter is subjected to axial torsional load and to axial and radial friction. These combined interacting loads act on the seams 15 particularly in the zone 59 between the shoulder 60 and the pouch neck 16. If the zone 59 comprises a sharp angle, tearing of the laminated foil constituting the pouch has been found to take place and this causes rupturing of the pouch 13 from which the pressurized product escapes. This tear generally only occurs when a pouch 13 is being filled for the second time. To ensure completely reliable operation, the zone 59 of the pouch 13 should not comprise a sharp angle but should be curved as shown in FIG. 7, and the zones 61 and 62 of sealing seams 15 should also be rounded.

Figure 9:
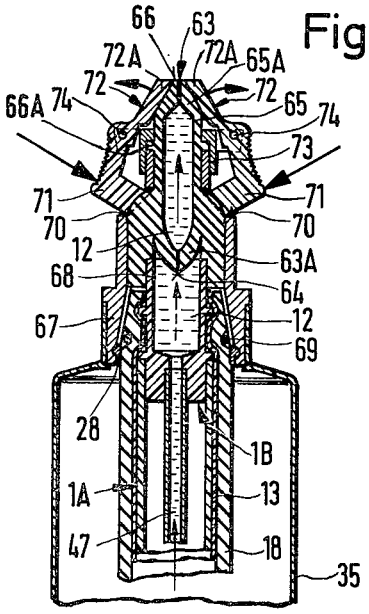
FIG. 9 shows a valve with no internal movable parts and having a frontal automatic closure means.
Figure 10:
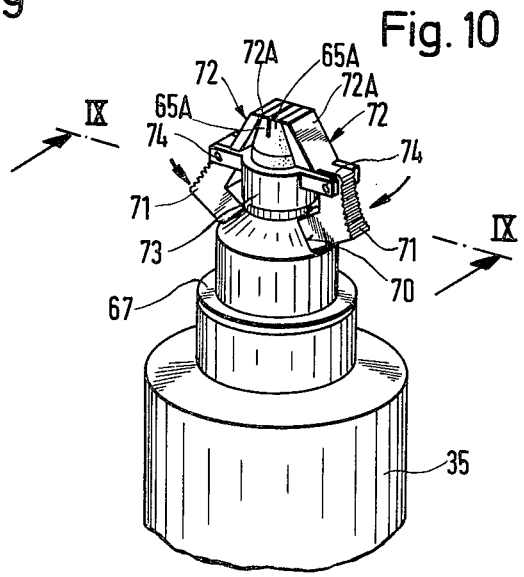
FIG. 10 is a perspective view.

FIG. 9 is a sectional view and FIG. 10 is a perspective view which illustrate a valve embodiment having no moving plunger. The possibility of protecting a product in a spray container in accordance with the invention against oxygen contained in the surrounding air, and of preventing an aroma given off by the product from diffusing outwardly, and of ensuring that the product remains sterile during the entire period in which it is used enables a large number of products to be satisfactorily packaged, provided that dehydration and contamination of the product are also prevented in the spaces necessary for accommodating a valve plunger and at the zone of the valve opening. It is obvious that in the zone of the valve, the product contained therein oxidizes, becomes dehydrated or is contaminated, but the manufacturers of such products consider that it is quite reasonable to ask the user to remove this small amount of the product with a piece of sterile cloth, provided of course that this lost amount is reduced as much as possible.

Valves, as illustrated in FIG. 20, are known which comprise retaining flaps made of plastics material and comprising two lips 102 which together form a cone, the tip 103 of which extends in the direction opposite to that, indicated by arrows 104, in which pressure is applied, the pressure thus urging the two lips firmly against each other, so that the pressurized medium cannot escape.

FIG. 9 illustrates a valve of this type used in the spray appliance in accordance with the invention, which valve is constituted by a valve housing 63 made of synthetic rubber and the tip 64 of the inner valve lips 63A of which is facing toward the pressurized product 12, this valve housing 63 also including at its opposite, outwardly facing end a dispenser part 65, having outer valve lips 65A the tip 66 of which points in the direction opposite to that of the tip 64. The valve housing 63 is connected at its lower end to a tube 68 which replaces the tubular joint 11 and is also a part of core part 1B used in the valve arrangement of FIGS. 1 to 6, since the valve housing 63 is secured to the part 1B of the core 1 by means of an annular flange 69 and a ring 28, the product 12 bears against the lips 64 and can escape through them only when they are parted. A bushing 67 entirely covers outer cylindrical face of the body 63 but leaves free two openings 70 designed to receive the arms 71 of a clip 72. The dispenser part 65 is fitted within a bushing 73 which is provided with hinges 74 on which the arms 71 are swingably mounted. The bushing 73, which is also provided with a mounting clasp, not illustrated, the complementary part of which is secured to the bushing 67, firmly urges a flat piece 66A, forming part of the dispenser 65, against the valve housing 63 as well as the bushing 67, so that the entire system is rendered airtight.

The clip 72 comprises the hinges 74 and arms 71, which latter are pivotally mounted on the hinges 74 and which each have an uprand extension 72A. The shape of the arms 71 is such that when they are fitted in the hinges 74 they apply pressure to the valve housing 63 at the zone of the opening 70, and to the dispenser part 65 in the zone of the outer lips 66, the synthetic rubber of which the body 63 and the dispenser 65 are made being of sufficient elasticity to require no spring to be provided in the hinges 74.

The valve assembly shown in FIGS. 9 and 10 operates in the following manner: the pressurized product 12, acting on the lip 64, presses them against each other and this causes the valve to be closed. The valve housing 63 is slightly deformed outwardly in the region of the openings 70, thus acting on the arms 71 and imparting the latter a rotary movement about the hinges 74 so that the extensions 72A firmly compress the lips 66 of the dispenser 65 so that the product 12, contained in the valve housing 63 and the dispenser part 65, is protected against oxygen of the surrounding air and against any micro-organisms that may be present therein, and the esential oils in product 12 are prevented from diffusing toward the outside.

When pressure is applied with two fingers to the outer faces of arms 71 they are displaced inwardly into the openings 70 towards the valve housing 63, and this causes deformation of the wall of the latter, whereby the lips 64 are caused to move apart. At the same time the extensions 72A move away from the lips 66. Since the lips 64 are open, the pressurized product 12 passes into the hollow interior of valve housing 53 and its pressure opens a passage between the lips 66 to escape to the outside. When pressure on the arms 71 is relaxed, the valve housing 63 resumes its original shape, and the lips 64 close again under the pressure of the product 12 from duct 47. The pressure within the housing 63 and the dispenser part 65 then drops as a result of the lips 64 already being closed, whereas the wall of the valve housing 63 has not yet resumed its initial shape. This drop in pressure aspirates that part of the product 12 located between the lips 66 which, at the same time, are again pressed against each other by the extensions 72A of the clip 72.

FIGS. 13, 14 and 15 illustrate another embodiment of the device for indicating the degree of filling of a pouch 13 housed in a rubber tube 18 a spray container in accordance with the invention. Formed in the container 75 is a recess 76 in which the indicating means is accommodated. The latter means comprise a hinge 77, a rod 78 to which a blade spring 79 is affixed, and an indicating segment 80 which, depending upon the degree of filling, is able to appear completely in a window. Expansion of the tube 18 displaces the rod 78 which, as displacement proceeds, moves the segment 80 underneath the window 81 so as to become fully visible therein when the tube 18 assumes the shape shown by the broken line. When the tube 18 contracts, the rod 78 is displaced in the opposite direction so that the segment 80 uncovers the window 81 as emptying of the spray container in accordance with the invention proceeds. In FIG. 14, segment 80 is visible in window 81, indicating the filled condition, and in FIG. 15, window 81 is unobturated which indicates that the spray container is empty.

Figure 17A:
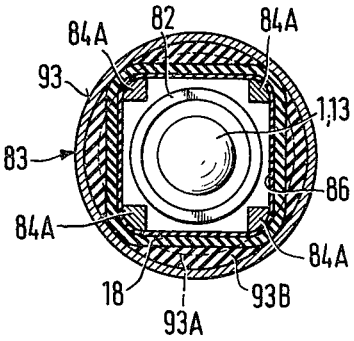
FIG. 17A is a bottom view of the assembled means, core, pouch and rubber tube shown in FIG. 16.
Figure 17:
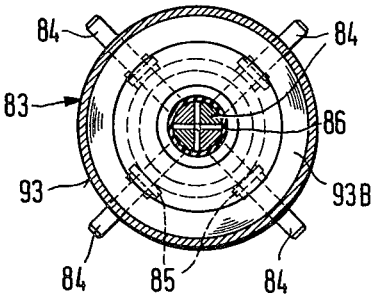
FIG. 17 is a cross-sectional view of the device shown in FIG. 16 in a plane indicated by XVII—XVII seen from below.
Figure 18:
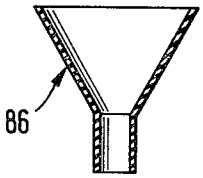
FIG. 18 is a sectional view of a rubber sleeve forming part of said means.

The introduction of the core 1, carrying the pouch 13, into the tube 18 poses an assembly problem in mass production wherein the assembly time must be as short as possible without adversely affecting the quality of the appliances produced. The problem stems on the one hand from the fact that the core 1 preferably has a diameter that is 75% greater than that of the tube 18, and that the rubber of which the tube 18 is made does not slide readily thereover. Furthermore, the pouch 13 should not be subjected to any strain. The method of introducing the core is illustrated in FIGS. 16, 17 and 18.

Before proceeding to describe this method, it should be mentioned that the rubber tube 18 will be lubricated on the inside by silicon oil, not only to enable it to slide for the purposes of assembly, but also to prevent it from causing slight friction during filling when the pouch 13 unwind radially as it fills, if it is wrapped around the core 1 as shown in FIG. 21, or may unfold laterally if, instead of being wrapped around the core 1, it is folded like a concertina as shown in FIG. 22, the folds being parallel to the longitudinal axis of the pouch 13.

Figure 16:
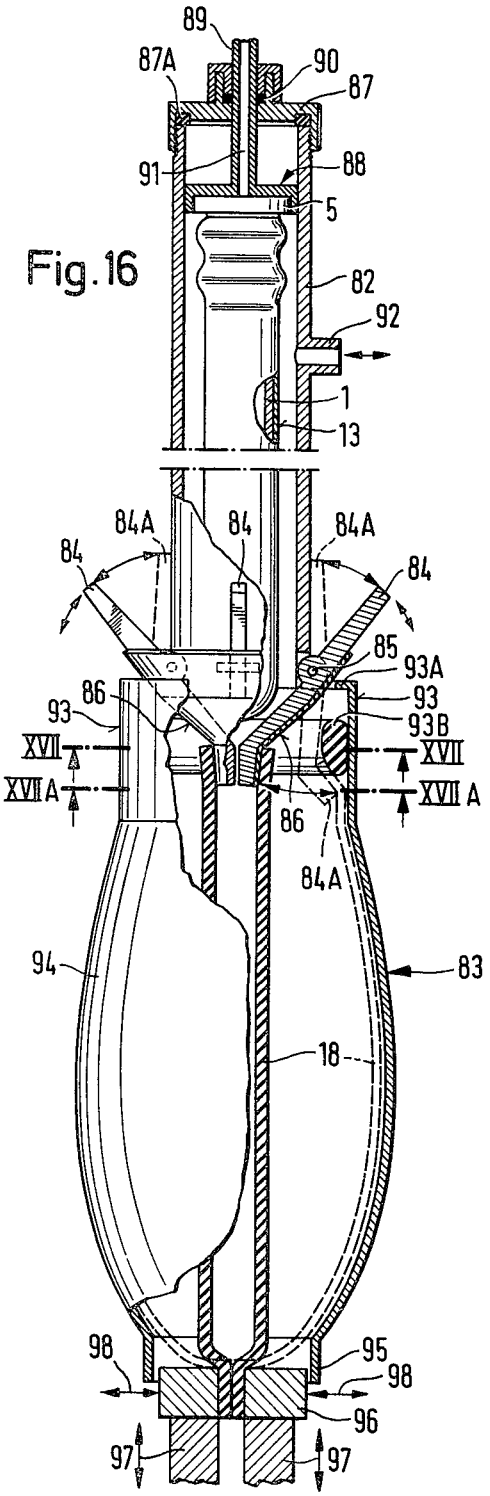
FIG. 16 is a view, partly in section, of a means for automatically introducing the core, carrying the pouch, into the rubber tube.

The apparatus illustrated in FIG. 16 consists of a charging cylinder 82 and a confining enclosure 83. At that of its ends that moves into contact with the enclosure 83, the cylinder 82 carries four levers 84, mounted on pivot pins 85, the levers and the pins being encased in a rubber sleeve 86. Means, not illustrated, are provided for bringing the levers 84 into the position indicated by the broken lines at 84A. The other end of the cylinder 82 is closed by a removable cap 87 which is sealed by a sealing element 87A and carries a pusher 88 movable in the axial direction. A rod 89 of the pusher 88 slides in a gasket 90 and has formed therein a duct 91 through which a vacuum can be generated by connection to a vacuum pump.

With the aid of a compressed-air port 92, the cylinder 82 can be pressurized. The enclosure 83 has a cylindrical portion 93 and an ovoidal portion 94. The cylindrical portion 93 is so formed that it bears against the periphery of the sleeve 86. The levers 84 are of such shape that when they move into the position shown at 84A they are not impeded by the upper edge 93A of the cylinder 93. A sealing ring 93B made of very flexible rubber establishes a seal between the tube 18 and the sleeve 86 by bearing against the sleeve 86. In the lower open end 95 of the enclosure 94 a clip 96 is located which holds the lower end of tube 18 clamped in, and which can be moved together therewith in the direction indicated by the arrows 92 and which can open and close in the direction indicated by the arrows 98. A device, not illustrated, enables the tube 18 to be cut off at the zone of the clip 96.

This device operates in the following manner: the core 1 and the pouch 13, previously fitted together, are placed in the cylinder 82 in such a way that they bear against the levers 84, the cap 87 being closed. The pusher 88 makes a perfect sealing fit with the seat 5 of part 1B, whereby air can be removed from the core 1 by suction through the duct 90. On the other hand, by means of the vacuum thus created, the pusher 88 retains the core 1 and, on the other hand, because of evacuation of air from the space between the pouch 13 and the core 1, it keeps the pouch wrapped round the core. At the same time, the levers 84 capped by the sleeve 86 are introduced into the tube 18 the other end of which is inserted in the clip 96. The enclosure 83 is then fitted around the tube 18. The levers 84 are then brought to the position indicated at 84A and this enlargens the tube 18, and compressed air is introduced into the assembly by way of the port 92. Consequently, the tube 18 expands axially and radially to a sufficient degree to enable the pusher 88 to push the core 1 and the pouch 13 downwardly towards the clip 96 into a position in which the core 1 abuts against the zone of the inside of expanded tube 18 which rest on top of clip 96, the core 1 always being retained by the pusher 88 because of the abovementioned vacuum. Thereafter, compressed air is exhausted through the port 92 so that tube 18 returns to its initial unexpanded shape, i.e. it contracts axially and radially and becomes positioned around the core 1 and the pouch 13. The levers 84 are then moved in the direction of their initial positions until they bear against the pusher 88, whereas the upper end of the tube 18 comes to rest on the outside of pouch 13 about the upper end of core 1. The vacuum is then relieved in the core 1 via plunger duct 91, and the clip 96 is then opened to release the lower end of tube 18, whereupon the enclosure 83 is gradually withdrawn downward from the assembly consisting of the core 1, the pouch 13 and the tube 18. At the same time, the levers 84 are again slightly moved towards the position shown at 84A and this enables the pusher 88 to be retracted. After the enclosure 83 has been withdrawn from the sleeve 86 it provides space for a device (not shown), which cuts off an upper excess portion of the tube 18 along the lower edge of the pusher 88. When the pusher 88 moves upwardly into its initial position, the cut-off portion of the tube 18 together with the assembly of core 1 and pouch 13 drop downwardly out of the assembly machine and the above-described work cycle can begin again.

The design of the spray appliance in accordance with the invention can be readily varied to suit the requirements imposed by the product to be contained therein, without departing from the scope of the invention.

Figure 23:
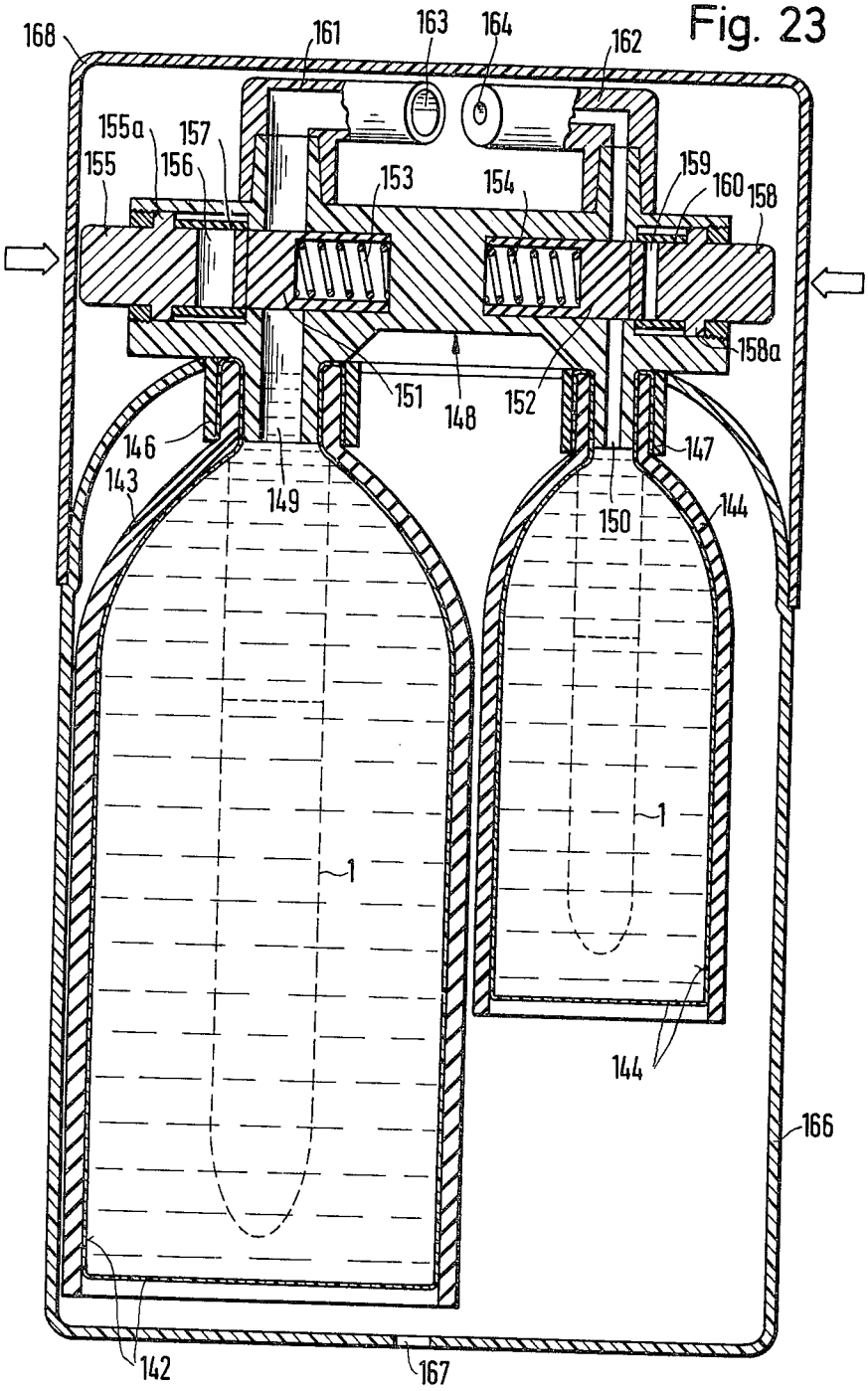
FIG. 23 shows a particular form of construction of the preferred embodiment of the invention.

FIG. 23 shows a sectional view of a double spray appliance designed for example for packaging two-component products. In this case the bag 142 has five times the volume of that of the bag 144, and the wall-thickness of the tube 143 is greater than that of the tube 145, both tubes being made of natural rubber. These two units are secured to the housing 148 of a valve with the aid of collars 146 and 147. It will be seen that the diameter of the discharge duct 149 of bag 142 is greater than that of the discharge duct 150 of bag 144. The difference in the wall-thickness of the tubes 143 and 145 and the difference in the diameters of the discharge ducts 149 and 150 ensure that a greater volume of product is released from the bag 142 than from the bag 144, and therefore to provide automatically a required mixing ratio of the two components, for example, a weight ratio of 1:5 , 1:10 etc. It is obvious that these values, i.e. the differences in wall-thickness and in diameter of the ducts can be selected to give any desired mixing ratio. The duct 149 is closed by a cylindrical plug 151, and the duct 150 by a cylindrical plug 152, these plugs being provided with internal springs 153 and 154, respectively. The plug 151 bears against a pusher 155 having a duct 156 which is obturated by the tube 157 made of synthetic rubber which will also function as a gasket. The plug 152 presses against the pusher 158 having a duct 159, which is obturated by the tube 160 made of synthetic rubber and also acting as a gasket. The ducts 149 and 150 are fitted with angled discharge tubes 161 and 162 which have openings 163 and 164, respectively, and which extend in such direction that the products issuing through the openings 163 and 164 become mixed with one another. The arrangement described is housed in a protective enclosure 166 having an opening 167 and closed by a cap 168.

To use the appliance, cap 168 is removed and the pushers 155 and 158 are compressed between two fingers. The duct 156 is brought into a position in which it registers with the duct 149, and the duct 159 into a position in which it registers with the duct 150, the pusher 155 and 158 on the one hand being, of course, guided in their axial movements without the possibility of rotation and, on the other hand, their stroke being limited. The products contained in the bags 142 and 144 are expelled in doses provided by the above-described means, and become mixed with one another after having passed through the openings 164 and 165.

Other forms of construction of the spray appliance in accordance with the invention are also possible.

FIGS. 24 and 25 show another embodiment of the valve and FIGS. 26 and 27 show in more detail the same embodiment, usable in a spray appliance according to the invention. Between the valve housing 169 and a cap nut 170 there is provided a gasket 171 of synthetic caoutchouc having a slotting 172, a rigid gasket or washer 173, a tube 174 of synthetic caoutchouc and a sleeve 175 which bears at its upper end a dispenser head 176 in which is inserted a spray nozzle member 177. This valve, which is under pressure of the product contained in a bag (not shown) as described herein before is closed due to the fact that the slotting 172 of the flexible gasket 171 is so devised, with bias in the mass of the synthetic caoutchouc thereof that the rims of the lip or tongue 172*a* formed by the slotting fit with a perfect seal against the rim of the surrounding gasket material, the slotting being inclined at an angle, whereby the upper face of the tongue 172*a* is smaller than the lower face of the same. Moreover, the tongue 172*a* abuts with bias against the lower open end of the sleeve 175, thus preventing the tongue 172*a* from being deflected under the pressure of the product. The tube 174 which is placed around the sleeve 175 has the function of a stuffing box when the sleeve 175 is displaced, by a depression of the dispenser head 176 toward the bag. Such displacement compresses the tube 174, thus creating the necessary sealing effect. The tube 174 also functions as a spring returning the sleeve 175 to its initial position as soon as pressure exercised on the dispenser head 176 ceases.

The lower, inwardly directed end of the sleeve 175 displaces, upon depression of the dispenser head 176 the tongue 172*a*, defecting the same downwardly toward the bag, whereby the slotting 172 is opened and product can escape from the bag past the tongue 172*a* toward the nozzle 177. As soon as the displacement of the sleeve 175 is reversed, the pressure of the product will again move the tongue 172*a* to seal the slotting 172 in the gasket 171 hermetically.

FIG. 27 shows a dosage device for use with the appliance according to the invention. When no propellant is used, discharge of a determined dose of the product can not be obtained as it would be in known spray devices in which the propellant gas in mixture with the product maintains its propellant force and its atomizing effect even after having left the container and while passing through the valve of the device.

In the spray appliance according to the invention, the product will not retain any expelling energy once it has been expelled from the bag or pouch. However, a dosification of the amount discharged is desirable in the case of a number of products such as mustard, mayonnaise, liquid extracts of coffee or tea or medicaments. To achieve this object, the bag 178 filled with such a product and the tube 179 of natural caoutchouc surrounding the bag are connected to a valve housing 180 in which a piston 181 is housed for reciprocating movement therein. This piston 181 is held in closing position by a spring 182 which latter is supported on a rigid washer or joint 183. The latter holds a flexible gasket 184 of synthetic caoutchouc in place on a transverse bottom part of valve housing 180. The piston 181 bears on its underside a piston pin or stem 185 extending toward the bag 178 and bearing at its lower end a valve cone 185*a* which, in closing position, hermetically seals a central bevelled opening 180*a* serving as a valve seat, thus hermetically obturating the bag 178. On its upper face, the piston 181 bears a sleeve 186 which is in communication with the interior of the valve housing 180 by passages 187 and 188 extending axially through the piston 181. The sleeve 186 is closed by a frustoconical valve member 189 which is held in place in the correspondingly levelled upper end of sleeve 186 by means of a spring 190 which is supported in a wall 191*a*, facing toward the sleeve 186, of an angular valve discharge head 191, the discharge opening 193 of which is disposed at a right angle to the central axis of valve housing 180 and sleeve 186. A cap screw 192 covers the upper end of valve housing 180 and serves as a stop for the upwardly moving piston 181.

The dosage device functions in the following manner: When the discharge head 191 is depressed by a finger applying pressure to the outside of wall 191*a* thereof the piston 181 is depressed via sleeve 186 downwardly into the valve housing 180 and product contained in the latter will pass through the passages 187 and 188 into the sleeve 186 and raise the valve member 189 overcoming the pressure of spring 190, and escape through discharge opening 193.

At the same time the piston stem 185 is displaced downwardly and moves the valve cone 185*a* out of contact with its seat in opening 180*a*, thereby freeing the latter opening. The central opening in the gasket 184 is fitted about the piston stem 185 and follows the downward movement of the latter being deflected into opening 180*a* and preserving the obturation between bag 178 and the valve stem 185. When pressure on the discharge head 191 ceases, the spring 182 will push the piston 181 upwardly, and the valve member 189 will be urged by the spring 190 into engagement with its seat in the upper end of sleeve 186 and obturate the latter.

Pressure of the product in bag 178 will act on the rim of the central opening in the flexible gasket 184 which rim, as it finds no stop to hold it down will be bend upwardly about the piston stem 185 and will free a passage for product flow toward the interior of valve housing 180 until the latter is filled. The passage remains open until the valve cone 185*a* is again seated firmly in the opening 180*a*. By means of the cap screw 192 it is possible to adjust the stroke of the piston 181 and thereby to change the dose of the product expelled by the action of the piston 181 as described hereinbefore.

As a further improvement, one or several balls of steel or the like material can be placed in the bag and will assist stirring upon deposits formed by products having a tendency to form sediment; in this case, it is necessary to provide in the bag a cage or the like means preventing the ball or balls from damaging the ball wall. Moreover a separate sealing element may be provided between the bag and the core in the region of contact between the two parts.

By selecting appropriate dimensions for the different passages (channels or ducts) in the valve assemblies described hereinbefore, it is possible to maintain a constant discharge rate of the product of, for instance, 0.5 grams per second or preferably only 0.25 grams per second even when the pressure in the interior of the bag varies due to aging of the caoutchouc tube 18 or due to other effects.

Figure 29:
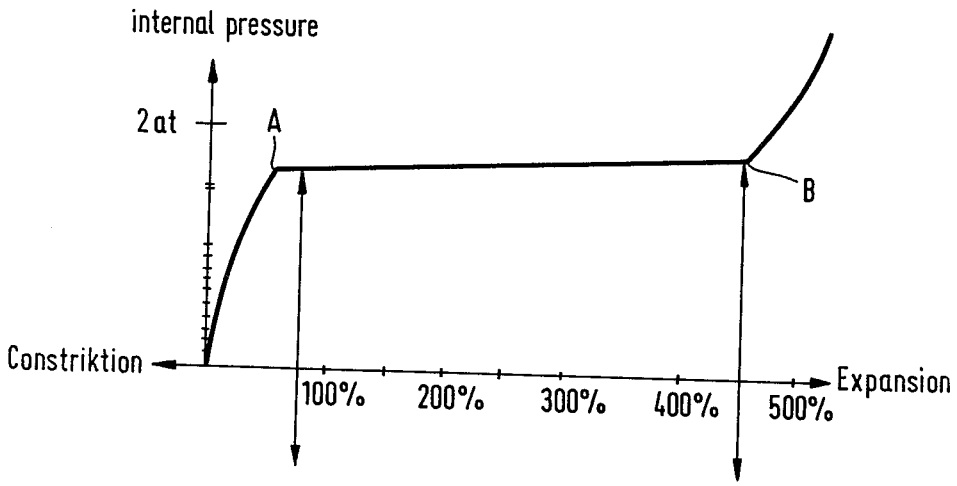
FIG. 29 shows a graph of the pressure curve of natural caoutchouc depending on the degree of expansion of the material

FIG. 29 shows in a graph the dependence of the internal pressure (ordinate) exercized by a tube 18 of natural cauotchouc having an internal cross sectional area 16× (corresponding to an internal diameter of 8 mm and a wall thickness of 3 mm) when in unexpanded condition, depending on the degree of expansion (abscissa) in percent calculated on the basis of the aforesaid unexpanded cross sectional arc 100% expansion mean that the last-mentioned cross sectional arca is doubled.

Expansion value A designates the minimum expansion limit caused by placing the tube on core 1, and expansion value B designates the maximum limit set by the maximum volume up to which the pouch 13 can be filled.

The region of the curve between expansion values A and B is referred to in this specification and the claims as "range of linear stretching" for the sake of brevity. The internal pressure in this range is almost constant, the increase or decrease being very slight (maximally about 7%).

Natural caoutchouc is preferred because of its longer "range of linear stretching" (from 50 to 450%) and less rapid aging. In storage for from 6 to 12 months a tube of natural caoutchouc having the above-mentioned dimensions suffers an enlargement of its diameter due to aging of about 20 to maximally 30%.

A synthetic rubber tube, e.g. of Buna® or Neopren® is subject to an enlargement of the internal diameter by at least 50% and its "range of linear stretching" is from about 40 to 350% only.

An outer enveloping tube 18 of natural caoutchouc is therefore preferred. Aging is particularly noticeable at the tip of an ovoidal enveloping element. A tube 18 having two open ends is therefore preferred.

Figure 30:
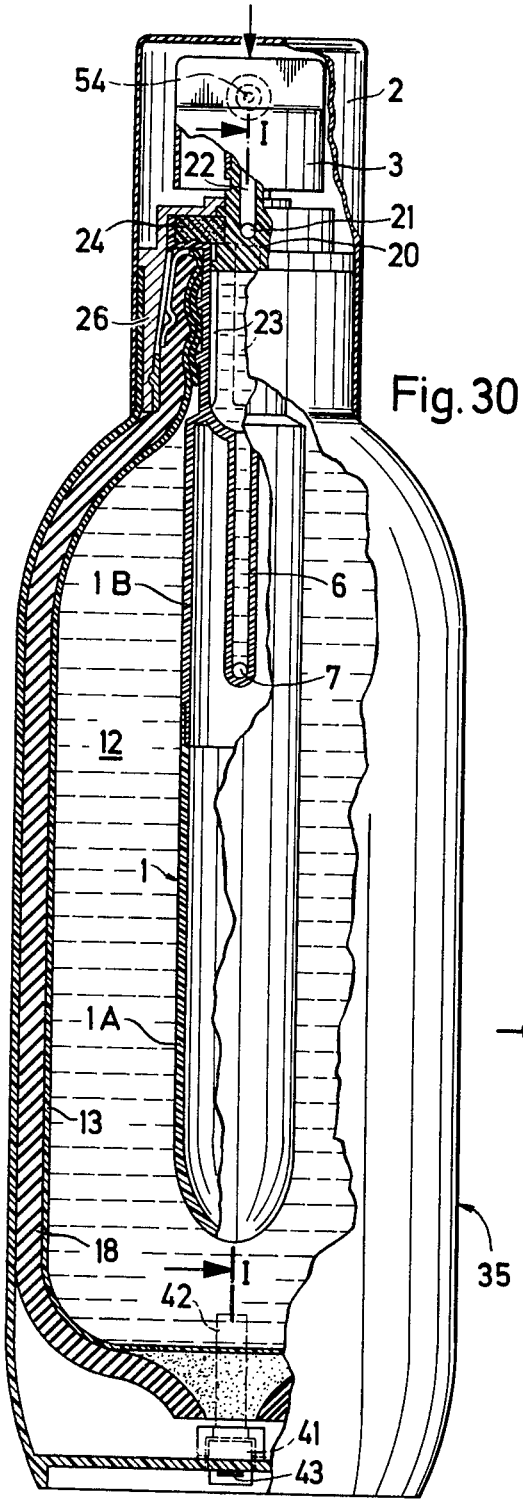
FIG. 30 is a lateral view, partly in axial section of the embodiment shown in FIG. 1 but turned 90° about its central axis.
Figure 31:
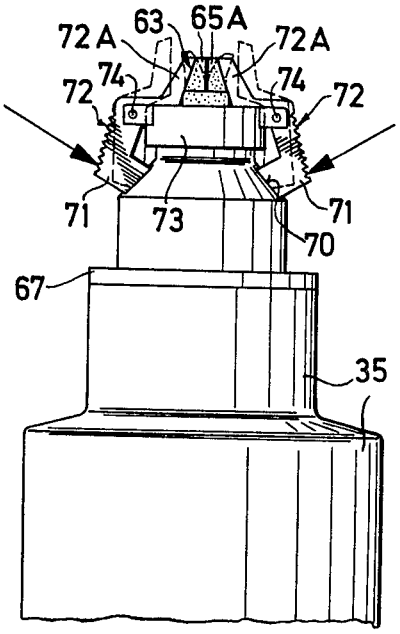
FIG. 31 is a lateral view of the upper part of an appliance, having a discharge head in the embodiment shown in FIGS. 9 and 10.
Figure 32:
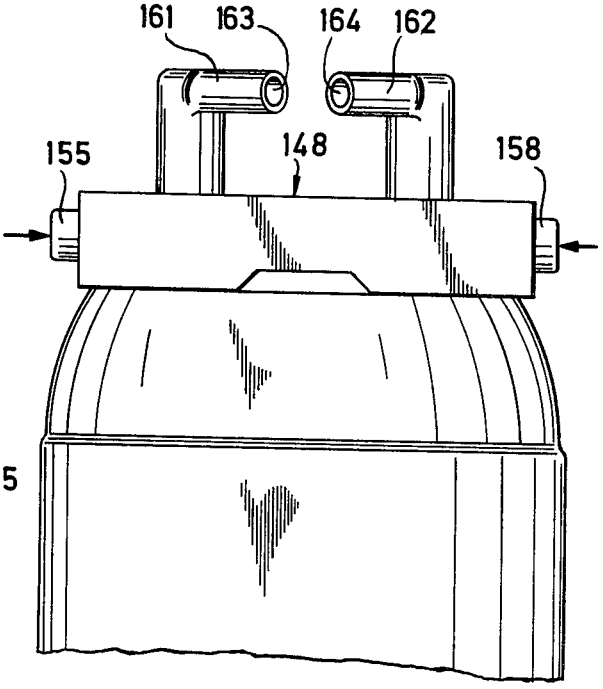
FIG. 32 is a lateral view of the upper part of the embodiment shown in FIG. 23.

The main structural features of the commercially most preferred embodiments shall now be summarized with reference to FIGS. 30, 31 and 32:

FIG. 30

| Ref. No. | |
|---|---|
| 2 | Cap |
| 3 | Spray Head-Coarseness 10 to 35 microns on granulometer for aqua solutions. Replaced by a pourer for non-spray products. |
| 24,27 | Tightening and sealing of the valve, bag and tube in polypropylene. Gasket based on nitrile rubber or butyl rubber adapted to the stored product. |
| 20 | Piston of the valve in polyethylene or polypropylene, has no metallic spring. |
| 1 | Hollow core in polyethylene sized according to the tube, comprises a tube of a small diameter in which the product acts as damping device before expulsion and assures the constant pressure on the valve level. It compensates the variations of the tube during storage, and ensures a steady output by controlling the degree of contraction of the tube. |
| 12 | Product as listed supra. |
| 13 | Inner bag in aluminum foil, laminated with a layer of polyethylene or polypropylene which alone is in contact with the products. The aluminum foil assures a perfect impermeability, protects the product against air-oxygen, as well as certain micro-organisms, and keeps the aroma (essential oils, extracts) from evaporating. The use of polyethylene sheets without aluminum foil, or that of synthetic rubber bag, such as butyl, does not give sufficient guarantees according to my tests. |
| 18 | Tube in natural, almost pure Para rubber (non-synthetic) in order to maintain an optimum permanent elasticity even over long storage. Thus a zone of linear force is obtained in order to permit a maximum of content for a minimum of container, and to ensure a steady output. Its weak resistance to expansion allows a fast filling cadence. |
| 35 | Container mantle can be in plastic, cardboard or metal with the design chosen by the user to his taste. |
| 41 | Gauge to indicate the degree of filling up. |

FIG. 31

Model with valve without any mobile part inside, nor metallic spring, with front closing, for the use of all pasty products to be kept from dehydration or contamination. Opened by pressure on the side (arrows).

FIG. 32

Model with the same valve as in FIG. 31 for pasty products of 2 components mixed at the issue according to desired proportions (1:1 to 1:10). Depending on viscosity of the product, delivered with a disposable mixer.

The novel spray appliance with atomizing nozzle can be used for all liquids such as:

| | |
|---|---|
| hair lacquers | paints |
| insecticides | perfumes, toilet waters |
| air fresheners | pharmaceutical products |
| deodorants | cleaning fluids. |
| oils | |

The new appliance with dispenser spout can be used for creams and liquids such as:

| | |
|---|---|
| cosmetic creams and milks | astringent lotions |
| shaving cremes | shampoos |
| tooth pastes | medicine (creams, syrups, drops) |
| antiseptic mouthwashes | cleansing creams |
| fruit, coffee or tea extracts | condiments (ketchup, mustards). |
| 2 component products | |

The usefulness of the appliances according to the invention shall now be briefly summarized: The novel appliances represent a revolutionary alternative to the aerosol spray cans now on the market worldwide and opens new fields for conditioning all kinds of products yet unstockable in gas aerosols and this in a cheap, clean and undangerous way.

Its most advantageous features are:

(a)—No propellant gas, especially no perhalogenated hydrocarbon (b)—No compressed air, hence no air-compressing pump (c)—Not more sensitive to heat or cold than the product to be dispensed (d)—Regular dispensing action (e)—No danger of explosion (f)—Not poisonous (g)—Protects contents from oxygen (h)—Uses bio-degradable elements.

The novel appliance according to the invention is founded on completely new technological advances and is without any danger for the user as well as for the environment.

Sterilized products remain sterile throughout the duration of use.

As the appliance functions exactly like gas sprays, although without gas, there is no necessity for the users of gas sprays to change their habits.

What is claimed is:

1. An appliance for discharging gaseous, liquid or pasty product comprising:

an inner pouch of deformable non-expandible material for holding said product, said pouch having an outlet end containing an orifice, and an opposite closed end constituted by an integral wall of said pouch;

an outer enveloping element of caoutchouc-type macromolecular material about said inner pouch;

a product outlet means associated with said outlet end of said pouch;

a valve device for controlling the discharge of product from said pouch through said outlet means and being disposed between the latter and said outlet end of said pouch;

an elongated rigid core of constant length located in the interior of said pouch and having a first and second end;

said valve device being mounted on said first end of said core;

said second end of said core being at all times close to said closed end of said pouch;

the cross-sectional area of said core being at least 40% larger than the internal cross-sectional area, taken in the same plane, of said outer enveloping element when the latter is in unexpanded condition, whereby said outer enveloping element in assembled condition surrounding said pouch containing said core, is expanded radially away from the central longitudinal axis of said core while remaining substantially unstretched in axial direction; and the maximum fillable volume available in said pouch being completely unfolded without expansion of its walls constituting the maximum limit of expansion of said outer enveloping element, said maximum limit being within the range of linear stretching of said caoutchouc-type macromolecular material.

2. The appliance of claim 1, wherein said core contains in its interior a conduit having at least two openings, at least one of which openings is located at a first end of said core which core end is directed toward said valve device, while the other end of said core is closed.

3. The appliance of claim 2, wherein said closed end of said core is rounded, and of smooth surface free from projections.

4. The appliance of claim 2, wherein said one end havng said at least one opening bears, or serves as, a valve seat of said valve device.

5. The appliance of claim 3, wherein said pouch, has a closed bottom, the rounded smooth-surfaced end of said core being spaced from said bottom of said pouch.

6. The appliance as described in claim 2, wherein said core comprises fastening means for fastening said pouch to said core near said first end of the latter in a hermetically sealed manner.

7. The appliance as described in claim 1, wherein said pouch consists of a folded laminate sheet welded at its superimposed edges except in a discharge outlet region.

8. The appliance as described in claim 1, wherein said outer enveloping element has the shape of a tube having two ends the upper end of which tube is fastened sealingly to said pouch or said core or both, while the lower end of said tube is open and extends downwardly beyond the bottom of said pouch.

9. The appliance of claim 8, further comprising clamping means which sealingly connect the upper end of said tube and the upper end of said pouch to said core near said first end of the latter.

10. The appliance of claim 4, wherein said valve device comprises a gasket of elastically flexible material.

11. The appliance of claim 1, wherein said product outlet comprises an atomizing nozzle.

12. The appliance of claim 1, wherein said product outlet comprises at least one discharge spout.

13. The appliance of claim 1, wherein said core consists of two parts, at least one of which is of adjustable length.

14. The appliance of claim 1, wherein the diameter of said core is at least 75% larger than the diameter of the interior of the unexpanded outer enveloping element.

15. The appliance of claim 1, wherein said piston is of plastics material and comprises spring means consisting of resilient fingers integral with said piston and protruding into an adjacent recess of said core.

16. The appliance of claim 6, further comprising clamping ring means for clamping an upper open end of said outer enveloping element on to the upper ends of said pouch and said core.

17. The appliance of claim 1, wherein said pouch comprises, about an outlet orifice thereof, a plurality of fingers adapted for being passed over and about the outside of the upper open end of said outer enveloping element.

18. The appliance of claim 1, wherein said valve device comprises gasket means for obturating the passage of product from said pouch into said product flow-ducts in said piston, said gasket means being of synthetic caoutchouc and serving as a return spring for said piston.

19. The appliance of claim 18, wherein said gasket means is of sufficient thickness to obturate an orifice of said ducts in said piston which orifice has a diameter above 0.5 mm.

20. The appliance of claim 1, wherein said outer enveloping element is a tube extruded from natural caoutchouc.

21. The appliance of claim 1, wherein said outer enveloping element is injection-molded from synthetic caoutchouc-type material.

22. The appliance of claim 1, further comprising an indicating device for indicating the degree of filling of said pouch with product.

23. The appliance of claim 22, wherein said indicating device is adapted for measuring the degree of expansion of said outer enveloping element.

24. The appliance of claim 1, wherein said pouch is made of deformable laminate sheet material constituted of at least three layers, an outer layer of which is of polyester, an intermediate layer is of aluminium foil and an inner layer of polyethylene or polypropylene, the latter layer being destined for contact with said product.

25. The appliance of claim 24, wherein said laminate sheet comprises a layer of polyester interposed between said intermediate aluminium layer and said inner layer.

26. The appliance of claim 24, wherein said intermediate aluminium layer has a thickness of at least 9 microns.

27. The appliance of claim 24, wherein said innermost polyethylene or polypropylene layer has a thickness of at least 50 microns.

28. The appliance of claim 24, wherein said innermost polyethylene or polypropylene layer has a thickness of at least 75 microns.

29. The appliance of claim 1, wherein the thickness of the wall of said outer enveloping element is at least 2.25 mm.

30. The appliance of claim 29, wherein the thickness of the wall of said outer enveloping element is about 3 mm.

31. The appliance of claim 1, further comprising an annular sealing element intermediate the upper ends of said pouch and said core.

32. The appliance of claim 1, wherein the cross-sectional area of said core is at least 50% larger than the cross-sectional area of said core of the interior of the unexpanded outer enveloping element.

33. The appliance of claim 1, wherein the total volume of all product flow paths in said first stage is four times the total volume of all product flow paths in said second stage and all passages for product from said pouch through said valve device to said product outlet are so dimensioned that the discharge rate of product is about 0.5 gram per second independently of the pressure prevailing in said pouch on the product therein.

34. The appliance of claim 1, wherein the total volume of all product flow paths in said first stage is four times the total volume of all product flow paths in said second stage and all passages for product from said pouch through said valve device to said product outlet are so dimensioned that the discharge rate of product is about 0.25 gram per second independently of the pressure prevailing in said pouch on the product therein.

35. An appliance for discharging gaseous, liquid or pasty product and comprising an inner pouch of deformable non-extensible material for holding said product; an outer enveloping element of caoutchouc-type macromolecular material about said inner pouch, a product outlet associated with said pouch and comprising an atomizing nozzle, a valve device for controlling the discharge of product from said pouch through said outlet being located intermediate the latter and said pouch, said valve device comprising a valve seat and a piston member adapted for obturating said valve seat and having ducts for the flow therethrough of product from said pouch to said nozzle, and a rigid core associated with said pouch, said nozzle having a central nozzle chamber and at least two connecting ducts leading from said central nozzle chamber to said expulsion mouth, and at least two successive turbulence-generating stages of channels, successively arranged in the direction of flow of the product through said nozzle and imparting rotation to the product flow therethrough, the following stage being superimposed on the preceding stage and imparting rotation to the product in the same sense as the preceding one; wherein the cross-sectional area of said core is at least 40% larger than the cross-sectional area, taken in the same plane, of the interior of said outer enveloping element in unexpanded condition, and wherein the maximum fillable volume in said pouch being completely unfolded without expansion of its walls constitutes the maximum limit of expansion of said outer enveloping element, said maximum limit being within the range of linear stretching of said caoutchouc-type macromolecular material, and wherein the sum of the cross-sectional areas of all product passages in said core, past said valve seat and through said piston, and in said nozzle, diminishes in the direction of product flow toward said expulsion mouth, and the total volume of all product flowpaths in said second stage is smaller than the corresponding total volume in said first stage.

* * * * *